US010573458B2

(12) United States Patent
Hull et al.

(10) Patent No.: US 10,573,458 B2
(45) Date of Patent: Feb. 25, 2020

(54) SUPERCONDUCTING AIR CORE INDUCTOR SYSTEMS AND METHODS

(71) Applicant: The Boeing Company, Chicago, IL (US)

(72) Inventors: John R. Hull, Sammamish, WA (US); Vyacheslav Khozikov, Bellevue, WA (US); Shengyi Liu, Sammamish, WA (US); Eugene V. Solodovnik, Lake Stevens, WA (US); John Dalton Williams, Decatur, AL (US)

(73) Assignee: THE BOEING COMPANY, Chicago, IL (US)

( * ) Notice: Subject to any disclaimer, the term of this patent is extended or adjusted under 35 U.S.C. 154(b) by 545 days.

(21) Appl. No.: 15/286,448

(22) Filed: Oct. 5, 2016

(65) Prior Publication Data

US 2018/0096785 A1 Apr. 5, 2018

(51) Int. Cl.
*H01F 6/04* (2006.01)
*H01F 41/04* (2006.01)
(Continued)

(52) U.S. Cl.
CPC ..... *H01F 41/048* (2013.01); *H01F 6/04* (2013.01); *H01F 37/005* (2013.01); *H01F 6/065* (2013.01)

(58) Field of Classification Search
CPC ..... H01F 36/00; H01F 6/04; H01F 37/005; H01F 27/106; H02K 11/33
(Continued)

(56) References Cited

U.S. PATENT DOCUMENTS 1,680,783 A * 8/1928 Gutzmann ..... H03B 19/03 336/198
3,414,698 A * 12/1968 Bedford ..... F24H 1/105 219/630

(Continued)

FOREIGN PATENT DOCUMENTS

JP 55125602 A * 9/1980 ..... H01F 6/02
JP 2000197263 A * 7/2000
JP 2007227771 A * 9/2007

OTHER PUBLICATIONS

Grzesik et al., Torodial Superconducting Transformer with Cold Magnetic Core—Results of Analysis and Measurements, 11th European Conference on Applied Superconductivity, Journal of Physics: Conference Series 507, 2014, Poland, 4 pages http://iopscience.iop.org/article/10.1088/1742-6596/507/3/032043/pdf.

*Primary Examiner* — Tszfung J Chan
(74) *Attorney, Agent, or Firm* — Haynes and Boone, LLP

(57) ABSTRACT

Provided is a low-weight, high-efficiency inductor design for use with or in electrical power equipment, such as inverters. A toroidal power inductor includes a support structure comprising an outer shell, an inner shell, and one or more coolant channels formed therebetween, a plurality of conductors wrapped around and supported by an exterior surface of the outer shell, and an interior cavity substantially enclosed by the inner shell of the toroidal support structure. The plurality of conductors are configured to provide an inductance for the toroidal power inductor, and the one or more coolant channels are distributed beneath the exterior surface of the outer shell to cool the plurality of conductors. An air-core power inductor may implement the conductors using high-temperature superconducting (HTS) tapes cooled by cryogenic fluid flowing within the coolant channels.

20 Claims, 17 Drawing Sheets

(51) Int. Cl.
*H01F 37/00* (2006.01)
*H01F 6/06* (2006.01)

(58) Field of Classification Search
USPC ..... 336/55, 58, 62, 229
See application file for complete search history.

(56) References Cited

U.S. PATENT DOCUMENTS 3,477,051 A * 11/1969 Clark ..... C25D 21/10 29/606
4,103,267 A * 7/1978 Olschewski ..... H01F 27/2804 29/606
4,639,707 A * 1/1987 Tanaka ..... H01F 30/16 336/185
5,130,687 A * 7/1992 Evrard ..... H01F 6/00 335/216
7,889,047 B2 * 2/2011 Yang ..... H01F 27/2804 336/229
7,990,244 B2 * 8/2011 Huss ..... H01F 27/2895 336/198
2004/0061584 A1 * 4/2004 Darmann ..... H01F 6/06 336/182

* cited by examiner

SUPERCONDUCTING AIR CORE INDUCTOR SYSTEMS AND METHODS

STATEMENT AS TO FEDERALLY SPONSORED RESEARCH

The invention described herein was made in the performance of work under NASA Contract No. NNC15AA01A and is subject to the provisions of Section 305 of the National Aeronautics and Space Act of 1958 (72 Stat. 435: 42 U.S.C. 2457).

TECHNICAL FIELD

One or more embodiments of the invention relate generally to air-core power inductors and more particularly, for example, to systems and methods to provide actively cooled superconducting air-core power inductors.

BACKGROUND

Filters used in power inverters are typically designed to satisfy a variety of electromagnetic interference (EMI) requirements in order to be used in particular applications, such as providing power to motors used to support powered terrestrial or airborne motion. For example, relatively poor-acting filters can significantly reduce the efficiency and lifespan of such motors, and relatively inefficient filters can significantly reduce the overall tactical range of such electromotive systems. Effective filters typically require one or more power inductors that are conventionally very large, power inefficient, and heavy; such power inductors are often responsible for a large fraction of the total weight of a power inverter, which can also significantly reduce the achievable range of such electrical vehicles.

For example, conventional power inductors often employ ferromagnetic cores in order to create a predetermined inductance within a relatively compact volume. Such inductors are not weight efficient, and, at high frequencies, can present significant energy losses/inefficiencies due to hysteresis and eddy currents formed within their ferromagnetic cores. Conventional superconducting inductors typically require complete immersion in cryogenic fluids or thermal sinking to the cold-head of a cryocooler, both of which can add considerable weight and/or complexity to the electrical power system. Thus, there is a need in the art for relatively low weight and high efficiency power inductor system designs and associated assembly methods, particularly across a wide range of operating frequencies and for use with electrically powered vehicles, including electrically powered aircraft systems.

SUMMARY

Techniques are disclosed for systems and methods to provide low weight air-core power inductors and related electrical components that can be assembled inexpensively and used to implement a variety of relatively efficient electrical power systems, including systems used to power various types of electrical vehicles, including terrestrial vehicles, aircraft, and aerospace vehicles. In various embodiments, an exemplary air-core power inductor may be implemented with a toroidal shape in order to facilitate compact design, weight reduction, and cooling, as described herein.

In one embodiment, a toroidal power inductor may include a toroidal support structure comprising an outer shell, an inner shell, and one or more coolant channels formed therebetween; a plurality of conductors wrapped around and supported by an exterior surface of the outer shell, wherein the plurality of conductors are configured to provide an inductance for the toroidal power inductor, and wherein the one or more coolant channels are distributed beneath the exterior surface of the outer shell to cool the plurality of conductors; and an interior cavity substantially enclosed by the inner shell of the toroidal support structure. The outer shell of the toroidal power inductor may include one or more exterior grooves that may be configured to receive the plurality of conductors and a corresponding one or more raised spacers disposed between the one or more exterior grooves and configured to prevent the plurality of conductive material from being displaced along the exterior surface of the support structure. In various embodiments, the toroidal power inductor may form part of a power inverter. In further embodiments, such power inverter may be coupled between a direct current (DC) power supply and an induction motor and be configured to provide electromotive power to an electrically powered mobile structure or vehicle.

In another embodiment, a method of assembling a toroidal power inductor may include fabricating a support structure for the toroidal power inductor, wherein the toroidal support structure comprises an outer shell, an inner shell, and one or more coolant channels formed therebetween, and wherein the inner shell is configured to form an interior cavity substantially enclosed by the inner shell of the toroidal support structure; assembling the support structure; preparing a plurality of conductors configured to provide an inductance for the toroidal power inductor; and mounting the plurality of conductors to the support structure, wherein the plurality of conductors are wrapped around and supported by an exterior surface of the outer shell, and wherein the one or more coolant channels are distributed beneath the exterior surface of the outer shell to cool the plurality of conductors.

The scope of the invention is defined by the claims, which are incorporated into this section by reference. A more complete understanding of embodiments of the invention will be afforded to those skilled in the art, as well as a realization of additional advantages thereof, by consideration of the following detailed description of one or more embodiments. Reference will be made to the appended sheets of drawings described briefly below.

BRIEF DESCRIPTION OF THE DRAWINGS

Embodiments of the invention and their advantages are best understood by referring to the detailed description that follows. It should be appreciated that like reference numerals are used to identify like elements illustrated in one or more of the figures.

DETAILED DESCRIPTION

Figure 1:
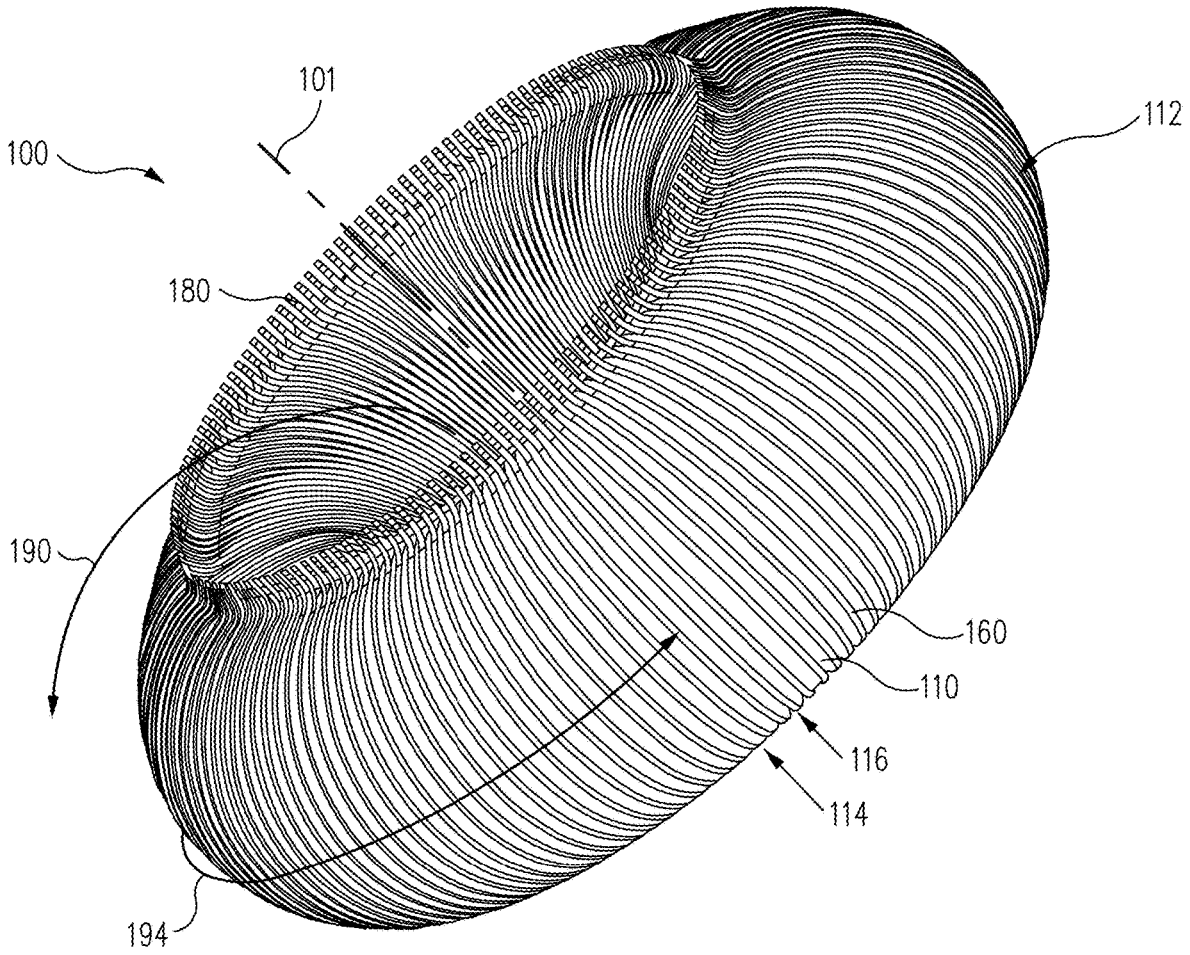
FIG. 1 illustrates an isometric view of a toroidal power inductor in accordance with one or more embodiments of the disclosure.

In accordance with various embodiments of the disclosure, a low weight toroidal power inductor is provided that may be used to produce a high power to weight ratio inverter for use in a variety of electrical power applications. In some embodiments, the toroidal power inductor may include an air core to help reduce overall weight, for example, and may be formed, at least in part, using superconducting conductors (e.g., such as high-temperature superconducting (HTS) wires or tapes) configured to generate the inductance of the power inductor and provide the relatively low power loss required by the types of high efficiency power inverters necessary to provide electrical propulsion systems, particularly for flight applications. In various embodiments, the conductors and/or toroidal power inductor may be cooled by a cooling system, which may include a coolant (e.g., a cryogenic fluid or fuel, which may be used for various purposes such as in a combustion turbine or a rocket motor) that may be, for example, provided by a mobile structure that the power toroidal inductor is mounted within. The coolant may be directed to flow along channels between an inner and outer shell of a support structure of the toroidal power inductor so as to keep the coolant substantially electrically isolated from the current carrying conductors and reduce a risk of unintended combustion of the coolant.

In one or more embodiments, the toroidal power inverter may be used in a hybrid electric commercial propulsion system used in vehicles (e.g., aerospace and/or aircraft designs, such as commercial planes) that, for example, may use cryogenic cooling and/or propulsion systems (e.g., liquid hydrogen, oxygen, methane, other hydrocarbons, and/or other cooled liquid combustibles and propellants). Electrical power equipment, including power inverters, may be used in such systems. For example, a cryogenically cooled 1 MW inverter that receives DC power and converts it to AC at frequencies as high as 3 kHz or higher may be used when meeting needs of possible aircraft electric propulsion systems. The inverter and/or components within the inverter may be designed to operate at cryogenic temperatures facilitated by an externally provided cooling source (e.g., a cryocooler and/or various cryogenic fluids or fuels) with a sink temperature below approximately 120 K. For the power inverter to have a relatively high power-capability to weight ratio, such as approximately 26 kW/kg (e.g., along with relatively high efficiencies of, for example, greater than 98%, such as 99.3% or higher), various components of the power inverter must have a relatively low weight. Furthermore, the power inverter typically must satisfy various relatively stringent electromagnetic interference (EMI) requirements that militate inclusion of high efficiency power filters capable of handling the power supplied by the power inverter, and such filters may include one or more power inductors. The present disclosure is directed to a power inductor for use in such filters and inverters, along with other power components that can take advantage of similar electrical structure and weight efficiencies, such as power transformers.

Referring now to the drawings, FIG. 1 illustrates an isometric view of a toroidal power inductor 100 (also referred to generally herein as an "inductor") in accordance with one or more embodiments of the disclosure. In one or more embodiments, inductor 100 may be implemented generally as a torus that is relatively symmetric about an axis 101 and has elliptical (e.g., including circular) cross sections. As understood by one skilled in the art, however, inductor 100 may also be implemented according to various other shapes and/or cross sections, such as a square or rectangular toroid having a rectangular cross section, for example, or one or more cylindrically shaped solenoids.

In one or more embodiments, inductor 100 includes a support structure 110, which may in various embodiments be fluted. For example, an exterior surface 112 of an outer surface of support structure 110 may include exterior grooves/conductor guides 116 and raised spacers/ribs 114. Spacers 114 and grooves 116 may be arranged substantially along a poloidal direction (e.g., as indicated by directional arrow 190) about support structure 110 and relative to axis 101, for example, and distributed across a toroidal direction (e.g., as indicated by directional arrow 194) about support structure 110 and relative to axis 101, as shown. As also shown in FIG. 1, grooves 116 may be configured to receive one or more conductors, such as conductor 160 (e.g., HTS tape), which may be configured to provide inductance for inductor 100. Thus, one or more conductors 160 may be received by grooves 116 bordered by spacers 114, which prevent conductors 160 from being displaced along exterior surface 112 of support structure 110. Furthermore, in some embodiments, conductors 160 may be electrically coupled to each other and/or to form conductive loops using conductive joints 180, as discussed further herein.

Figure 2A:
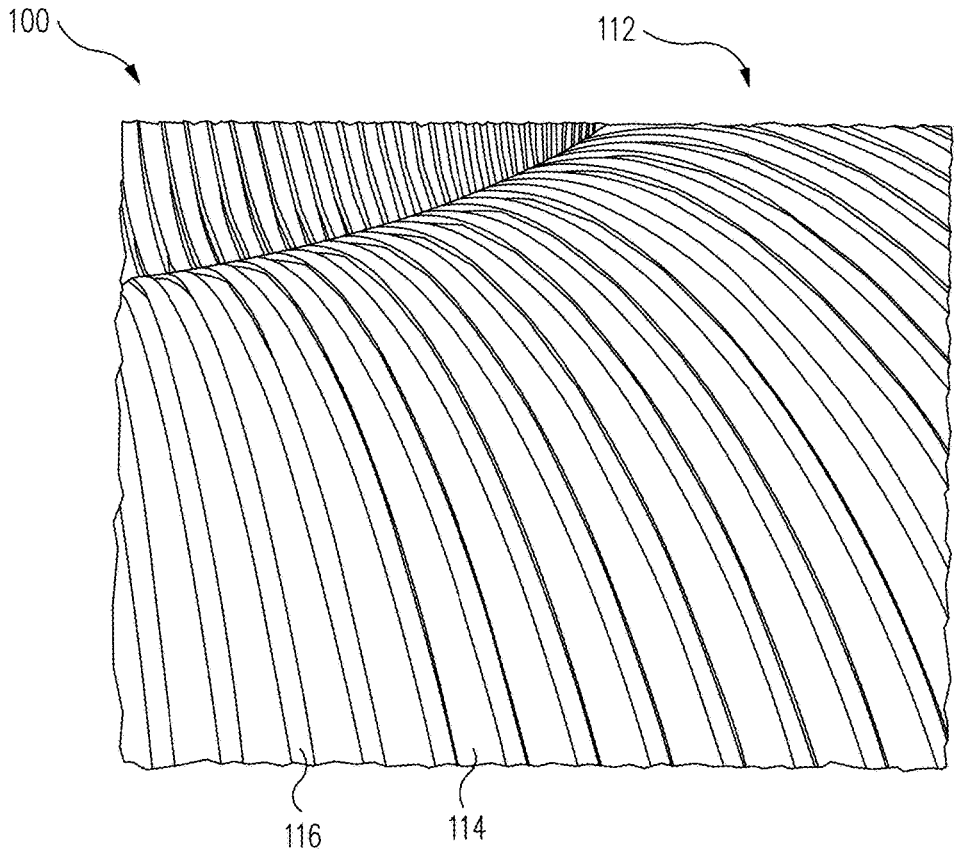
FIGS. 2A and 2B illustrate portions of a toroidal power inductor in accordance with one or more embodiments of the disclosure.
Figure 2B:
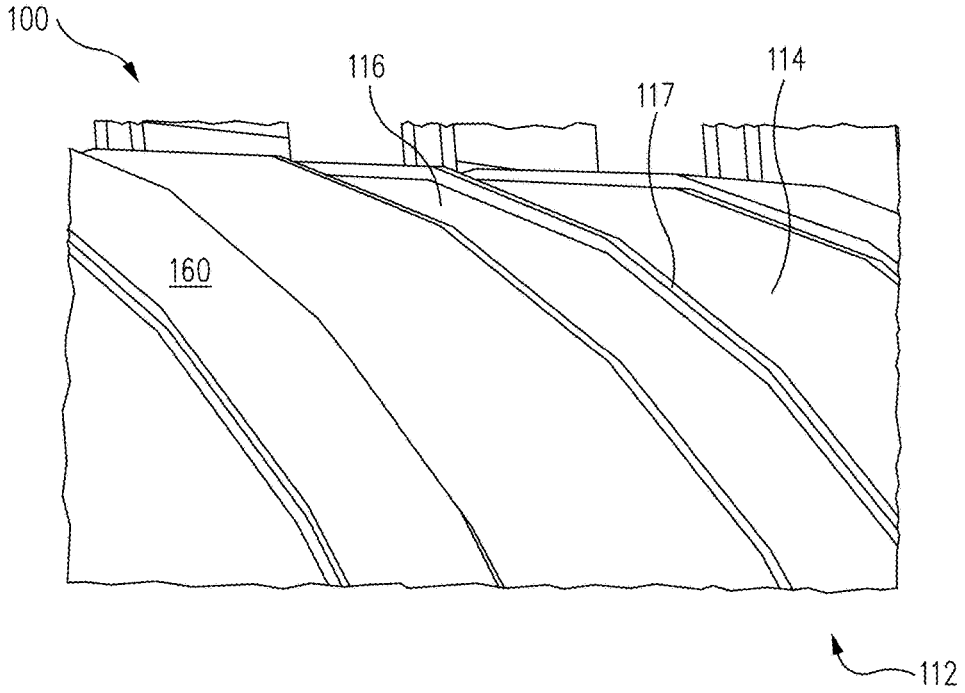

FIGS. 2A and 2B illustrate conductors 160, spacers 114, and grooves 116 on exterior surface 112 of an outer shell (e.g., outer shell 310 of FIG. 3) of toroidal power inductor 100. FIG. 2A shows support structure 110 without conductors 160 in order to illustrate how support structure 110 provides spacers 114 and grooves 116. In FIG. 2B, one groove 116 is shown without a conductor 160 disposed therein. One or more conductors 160 (e.g., layers or stacks of conductor 160) may be disposed within each groove 116. In one or more embodiments, conductors 160 may be prevented from being displaced along exterior surface 112 of support structure 110 by groves 116 and/or spacers 114 positioned on either side of each groove 116. For example, a single groove 116 may be disposed between two spacers 114. Each spacer 114 may include edges 117 configured to define either side of groove 116 and abut conductor 160, preventing conductor 160 from being displaced within groove 116 and/or along exterior surface 112 of an outer shell of support structure 110.

Figure 3:
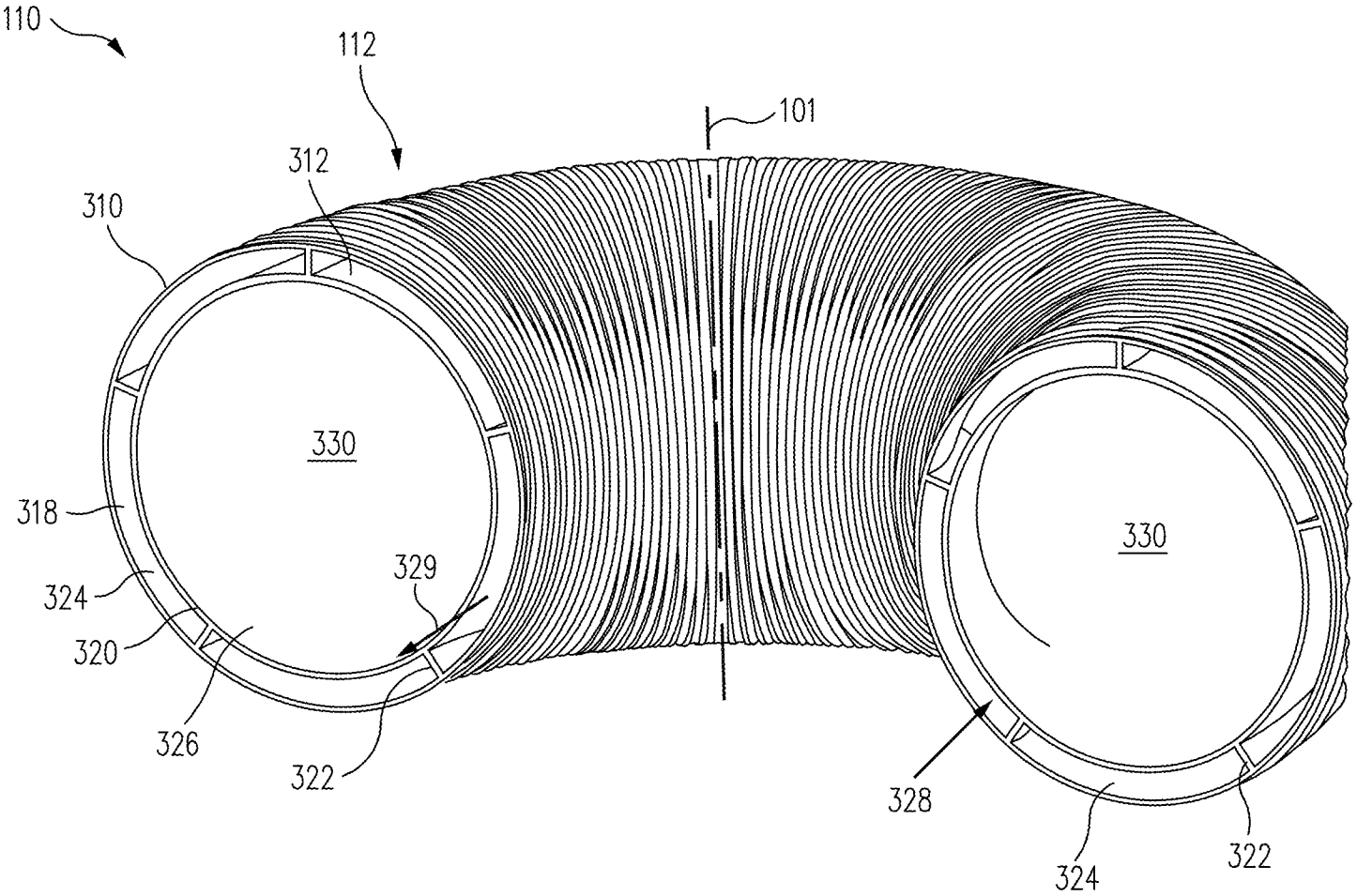
FIG. 3 illustrates a cross section view of a support structure for a toroidal power inductor in accordance with one or more embodiments of the disclosure.

FIG. 3 illustrates a cross section view of support structure 110 for toroidal power inductor 100 in accordance with one or more embodiments of the disclosure. Support structure 110 includes outer shell 310 and an inner shell 320 with interior surfaces 318 and 326, respectively. An interior cavity 330 may be substantially enclosed by inner shell 320. Outer shell 310 provides exterior surface 112 (see FIGS. 1 and 2) with exterior grooves 116 and interior surface 318, which may provide interior grooves 316 (see FIGS. 4, 5, and 6).

In one or more embodiments, outer shell 310 and inner shell 320 may be coupled and/or fixed relative to each other by channel dividers 322. Furthermore, one or more coolant channels 324 may be formed between outer shell 310 and inner shell 320 (e.g., between interior surface 318 and an outer surface 312 of inner shell 320), which may be defined by channel dividers 322, as shown. Coolant channels 324 may be distributed beneath outer shell 310 to cool conductors 160 that are disposed in/wound along exterior grooves 116 of outer shell 310 by conducting cryogenic fluid or gas to contact portions of interior surface 318.

For example, a coolant in liquid or gaseous form may be circulated through channels 324 as indicated by directional arrows 328 and 329, which show an overall example coolant flow through support structure 110 and between outer shell 310 and inner shell 320. The coolant may be provided by an external cooling system associated with, for example, a mobile structure (e.g., a terrestrial vehicle, aircraft, aerospace vehicle, or maritime vessel). For example, a cryogenic fuel may be provided by a coolant system of a mobile structure, may flow adjacent to conductors 160 at least partially through channels 324, and may extract heat from conductors 160 on exterior surface 112.

Figure 4:
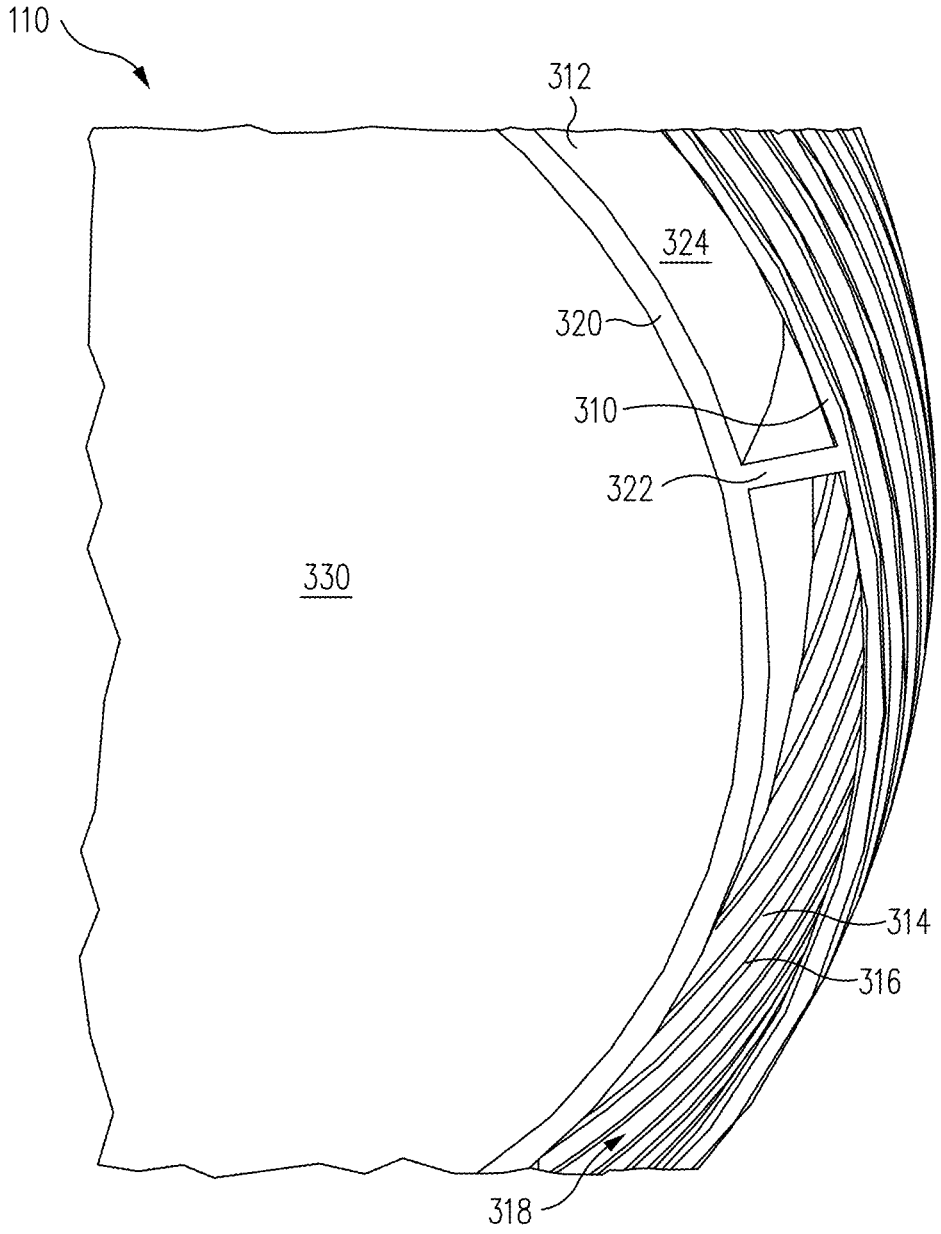
FIG. 4 illustrates a cross section view of coolant channels in a support structure for a toroidal power inductor in accordance with one or more embodiments of the disclosure.

FIG. 4 illustrates a cross section view of coolant channels 324 in support structure 110 for toroidal power inductor 100 in accordance with one or more embodiments of the disclosure. In various embodiments, interior surface 318 of outer shell 310 may include interior spacers/ridges 314 and interior grooves 316. In one embodiment, interior grooves 316 and interior spacers 314 may be aligned with exterior grooves 116 and raised spacers 114, respectively. For example, a cryogenic coolant from a coolant system may flow along interior grooves 316 to extract heat from or cool conductors 160 disposed in adjacent grooves 116. Interior spacers 314 may be configured to prevent the coolant from leaking uncontrollably along the interior surface 318, thereby keeping the coolant aligned with interior grooves 316 and thus exterior grooves 116 and conductors 160.

In another embodiment, cryogenic fluid may flow along the long circumference of support structure 110 through each coolant channel 324 as defined by at least a portion of outer shell 310, inner shell 320, and channel dividers 322. Grooves 316, spacers 314, and/or channels 324 may aid in preventing gases from rising to the upper half of support structure 110 and leaving upper portions of power inductor 100 substantially undercooled or uncooled (e.g., due to lack of fluid contact within an upper portion of interior grooves 316). In various embodiments, support structure 110 may be configured to force the cryogenic fluid to flow substantially along the poloidal (e.g., altitudinally as indicated by arrow 190 of FIG. 1) or toroidal (e.g., azimuthally or circumferentially around the toroid, as indicated by arrow 194 of FIG. 1) direction relative to axis 101 of inductor 100.

Figure 5:
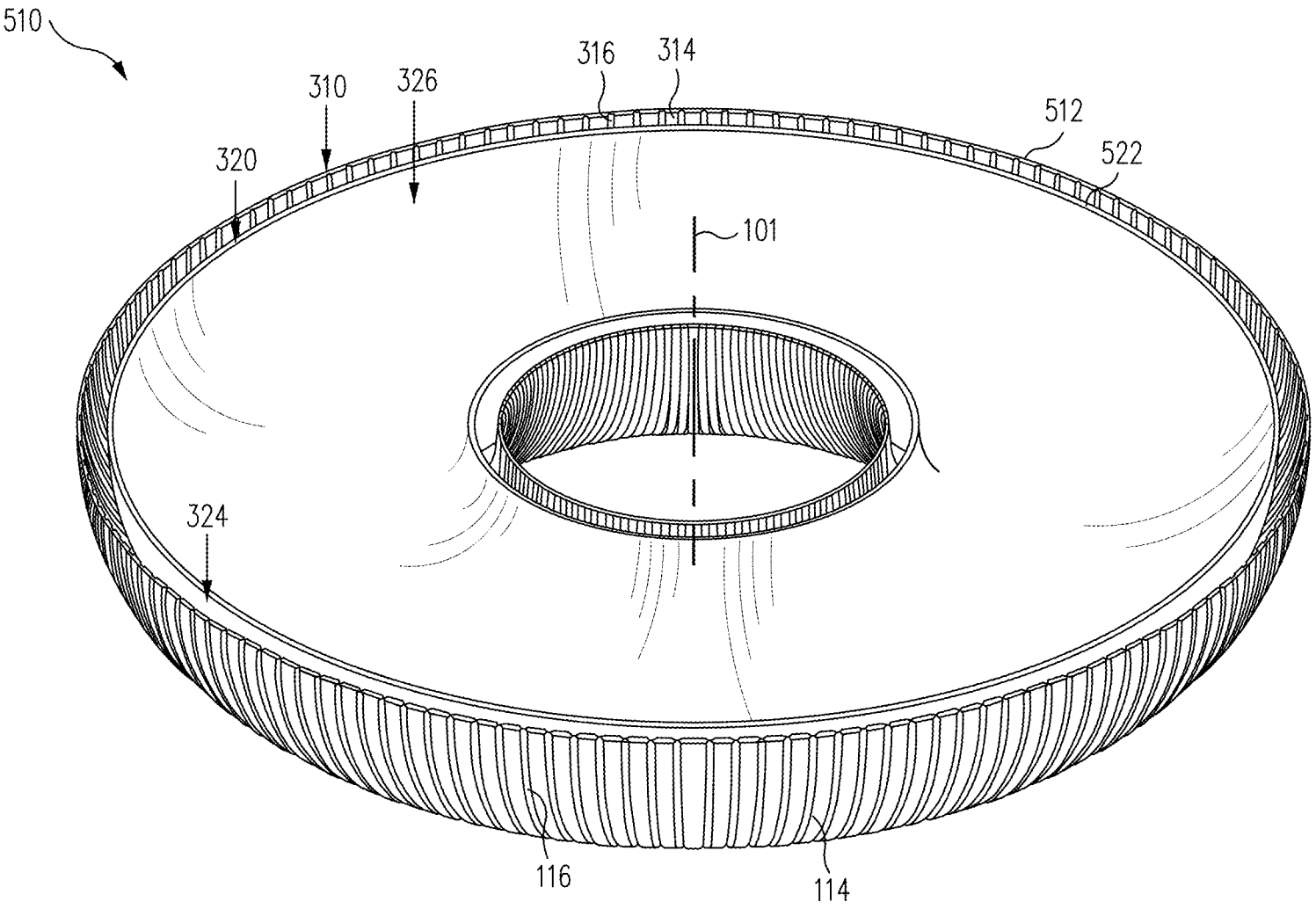
FIG. 5 illustrates a bottom half of a support structure for a toroidal power inductor in accordance with one or more embodiments of the disclosure.

FIG. 5 illustrates a bottom half 510 of support structure 110 for toroidal power inductor 100 prior to assembly to a top half of support structure 110, in accordance with one or more embodiments of the disclosure. As shown in FIG. 5, a bottom half of inner shell 320 is disposed within a bottom half of outer shell 310. Channel 324 is disposed between outer shell 310 and inner shell 320 and interior cavity 330 is defined by interior surface 326 of inner shell 320. Bottom half 510 may be provided or fabricated using various methods such as, for example, various types of molding, 3D printing techniques, and/or other fabrication techniques. An upper half may be fabricated using similar techniques, for example, and the upper half and bottom half 510 may be joined together using one or more types of sealing adhesives, for example. In some embodiments, circumferential ledges and/or complementary tongues may be formed along bottom half 510 and/or the upper half of support structure 110, such as along respective edges 512 and 522 of outer shell 310 and inner shell 320, so that the ledges and tongues may engage and couple/secure the upper and lower halves of support structure 110 together. In related embodiments, the ledges and/or tongues may be configured to provide circumferential grooves or cups into which a liquid adhesive may be poured as part of the assembly process to allow the adhesive to cure about the joint between the two halves and form a cryogenically sealed joint without marring the interior or exterior surface features of outer shell 310 or inner shell 320, such as by overflow of such adhesive.

Separate pieces of support structure 101 may be provided by 3D printing or molding, or the entire support structure may be printed without any joints, for example, and may utilize sacrificial structures and/or materials. For example, support structure 101 may be printed as a single piece, for example, and such fabrication can result in a support structure weighing approximately 1 to 4 kilograms and approximately 1 meter in length, and producing an inductance of approximately 10 μH when wound with conductors 160, as described herein.

Figure 6:
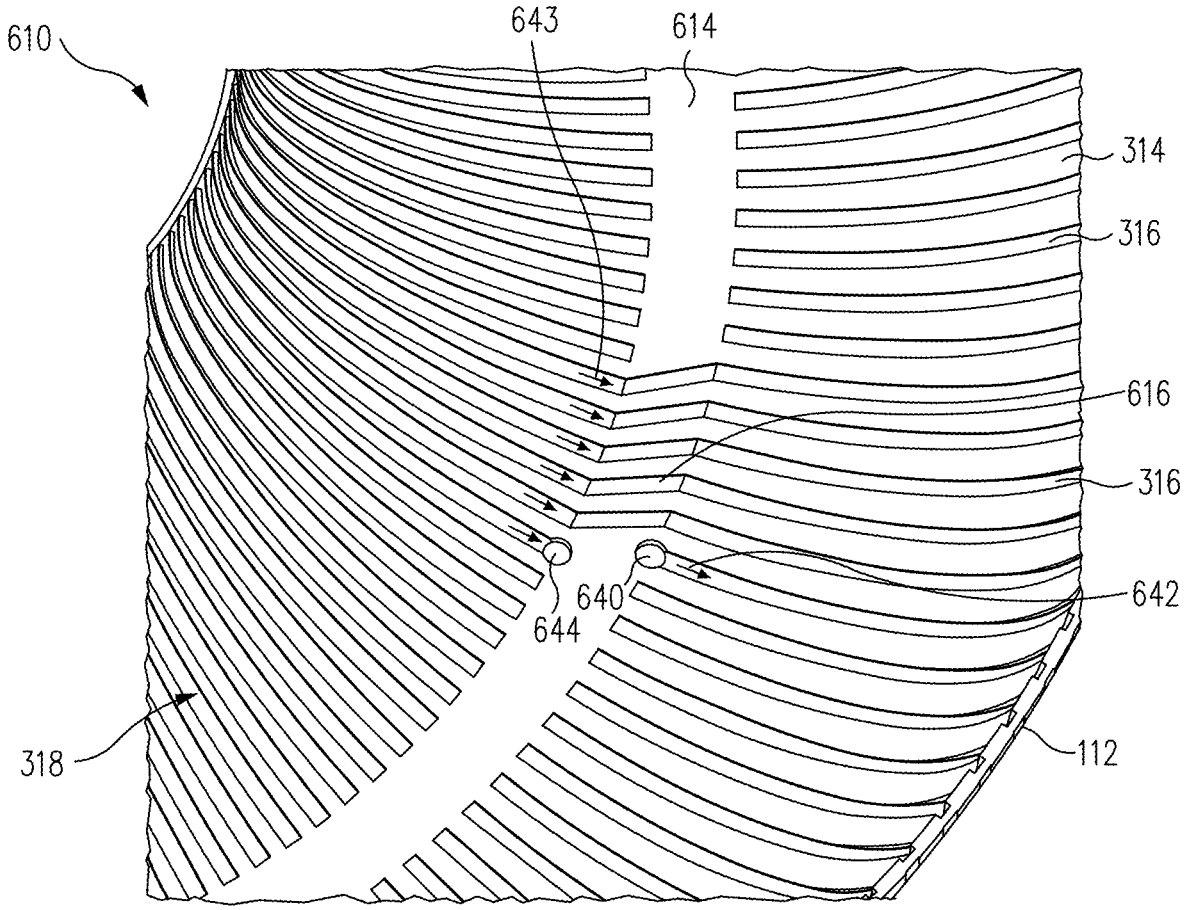
FIG. 6 illustrates substantially circumferential coolant channels in a support structure for a toroidal power inductor in accordance with one or more embodiments of the disclosure.

FIG. 6 illustrates substantially circumferential coolant channels in a portion 610 of support structure 110 for toroidal power inductor 100 in accordance with one or more embodiments of the disclosure. As shown in FIG. 6, outer shell 310 may be configured to provide an inlet 640 and an outlet 644. Coolant may enter outer shell 310 via inlet 640 and flow along grooves 316 of interior surface 318 as indicated by directional arrow 642 and thereby cool conductors 160 on exterior surface 112 of outer shell 310 through thermal conduction through the relatively thin portion of outer shell 310 defined by exterior grooves 116 and/or interior grooves 316, for example. Intermediate groove guides 616 may be provided at support base 614 to join opposing interior grooves 316 to form a single continuous groove or a series of continuous grooves about support structure 101 and provide continuous flow of the cryogenic fluid, as indicated by directional arrows 643. Providing intermediate groove guides 616 at support base 614 (e.g., as opposed to elsewhere along interior surface 318) may be advantageous in that support base 614 may be positioned substantially adjacent to portions of conductors 160 that are formed into connections 180 and not in direct contact with support structure 110 (e.g., see FIG. 1, where connections 180 may be substantially adjacent support base 614 of support structure 110), and so any spatial misalignment between intermediate groove guides 616 and conductors 160 may not be detrimental to overall cooling of conductors 160. Furthermore, one or more interior grooves 316 may terminate at one or more outlets 644 such that the cryogenic fluid may exit the outer shell 310 via outlet 644, as indicated by directional arrow 643. In one or more embodiments, more than one pair of inlets and outlets may be provided by the outer shell, thus providing multiple parallel flows of coolant across interior surface 318.

Figure 7A:
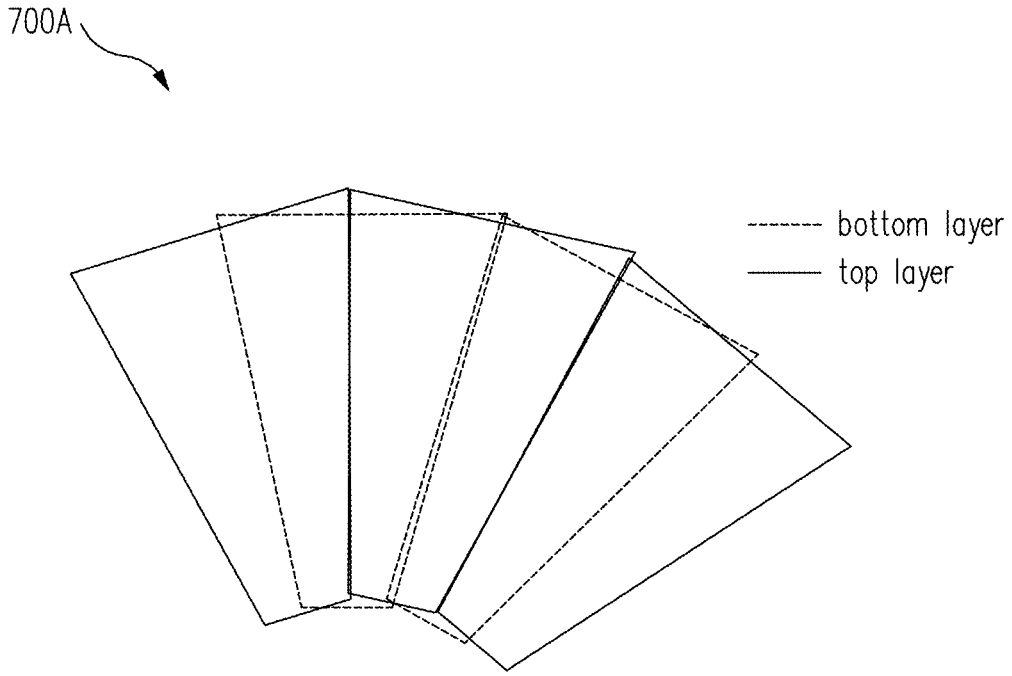
FIGS. 7A and 7B illustrate fabrication and general shape design constraints and parameters for a toroidal power inductor in accordance with one or more embodiments of the disclosure.
Figure 7B:
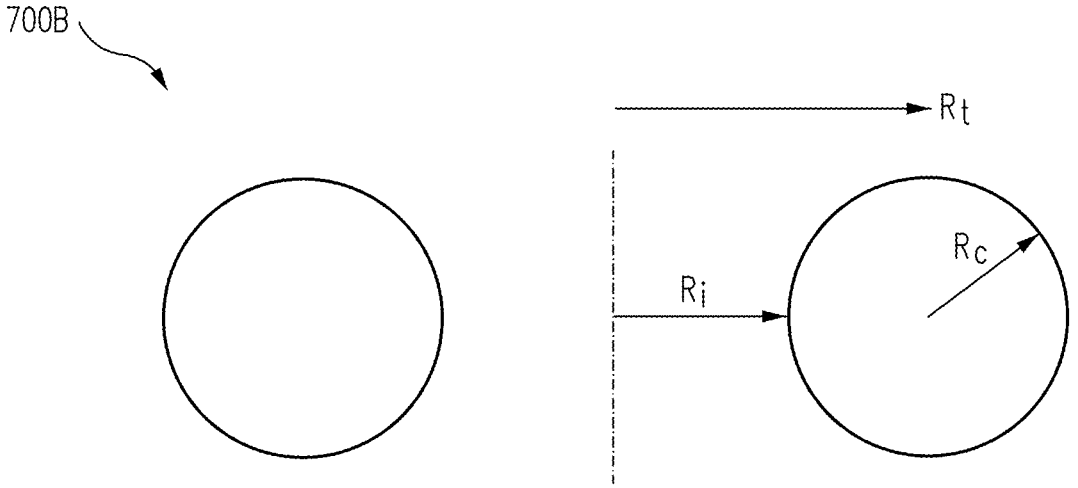

FIGS. 7A and 7B illustrate fabrication and general shape design constraints and parameters for toroidal power inductor 100 in accordance with one or more embodiments of the disclosure. As mentioned herein, support structure 110 may be provided using a molding fabrication. For example, patterned top and bottom layers or piles 700A may be overlapped and draped over a toroidal mold as shown in FIG. 7A to form the top or bottom half of support structure 110. At least two layers (e.g., each including adhesives) and the mold may then be placed into a vacuum bag to be allowed to cure and form at least a portion of support structure 110. Such molding procedures can result in movement of the layers relative to each other during curing, resulting in a top and bottom half (e.g., similar to bottom half 510 of FIG. 5) that are not properly aligned for sealed assembly. In other embodiments, a mold press may be used to produce portions of support structure 110 with higher spatial tolerances. For example, castable ceramics with silica carbide may be pressed into a mold to form a top and/or bottom half of the support structure. In further embodiments, interior or exterior grooves or other surface structures or overall shapes may be machined onto the surfaces of the shells, or the shells may be machined out of bulk material. In still further embodiments, 3D printing fabrication techniques may be used to provide an entire support structure without any joints as well as a potentially thinner and thus lighter support structure.

In various embodiments, support structure 110 may be formed from any material that can withstand cryogenic temperatures and/or thermal cycling between cryogenic temperatures and room temperature, for example. Such material or combination of materials preferably is thermally conductive, is permeable to magnetic fields, and/or is not electrically conductive. Such materials may include, but are not limited to, G-10 fiberglass composite, polyetherketoneketone (PEKK), silica carbide fibers, alumina, and/or alumina nitrate. For example, a silica carbide fiber based material could be configured to provide a support structure with a thermal conductivity approximately 2 orders of magnitude higher than that produced by a PEKK based material.

FIG. 7B shows radii parameters 700B. Toroidal radius $R_t$ and circle radius $R_c$ are the primary parameters for a regular torus, and the inner radius $R_i$ can be useful as discussed in FIGS. 8A and 8B.

Figure 8B:
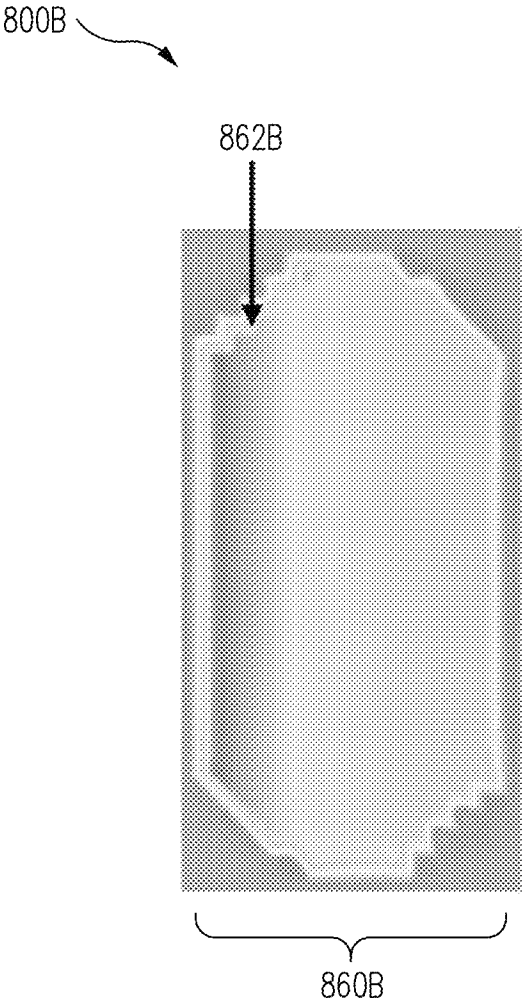
FIGS. 8A and 8B illustrate magnetic field distributions according to various toroidal geometries in accordance with one or more embodiments of the disclosure.
Figure 8A:
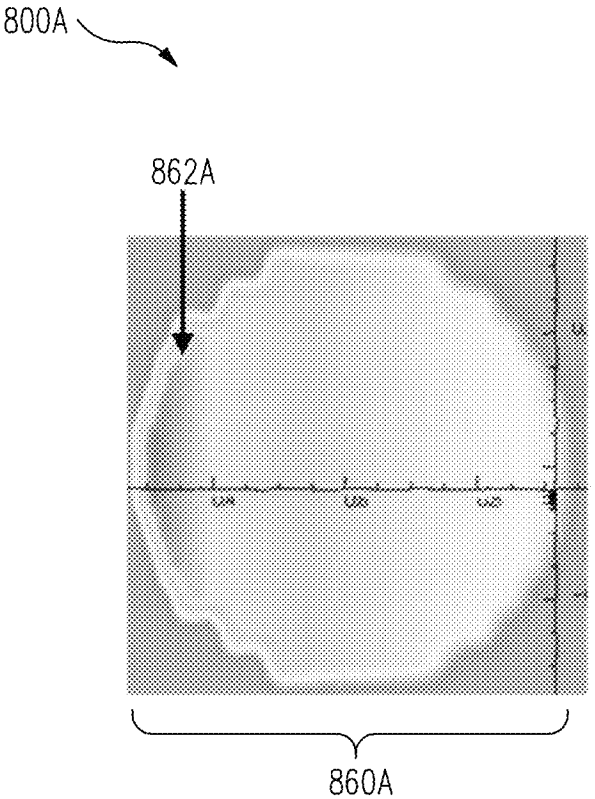

FIGS. 8A and 8B illustrate magnetic field distributions 860A and 860B according to various toroidal geometries in accordance with one or more embodiments of the disclosure. More particularly, FIGS. 8A and 8B illustrate the relative benefits of using an extended torus shape (e.g., a toroid extended along the direction of toroidal centerline axis 101 in FIG. 1) to implement toroidal power inductor 100. Each represents a magnetic field distribution for inductors having the same inner radius $R_i$ and the same number of total turns. The magnetic field strength is plotted as a function of the perpendicular distance from the centerline axis 101 and the distance from the center of the torus parallel to the centerline axis 101, where darker shading indicates stronger field strengths. For both plots 800A and 800B, toroidal centerline 101 is to the left of the plot. As can be seen in both plots 800A and 800B, the magnetic field generated by the inductive windings/turns is strongest in the internal volume (e.g., corresponding to cavity 330 in FIG. 3) closest to centerline 101, as shown by plot areas 862A and 862B, respectively.

Plot 800A shows magnetic field distribution 860A generated by an inductor with the geometry of a circular torus (e.g., having circular cross-section). In plot 800A, the magnetic field furthest from centerline 101 is significantly reduced from the maximum value, and the volume of the strongest portion of magnetic field distribution 860A indicated by plot area 862A is relatively small. Plot 800B shows magnetic field distribution 860B for the extended toroidal geometry (e.g., ellipsoid cross-section with the major axis aligned with the centerline axis 101). In plot 800B, the magnetic field furthest from centerline 101 is not as reduced from the maximum value as in the circular torus, and the volume of the strongest portion of magnetic field distribution 860B indicated by plot area 862B is much larger than that indicated in the circular torus by plot area 862A. In summary, the extended toroid shaped inductor produces a maximum magnetic field over a larger portion of its internal volume and has a larger minimum magnetic field over its entire internal volume than the circular torus shaped inductor, which equates to a higher inductance for the same number of windings and approximately the same overall volume, or, alternatively, an overall smaller volume for a particular desired inductance.

Figure 9:
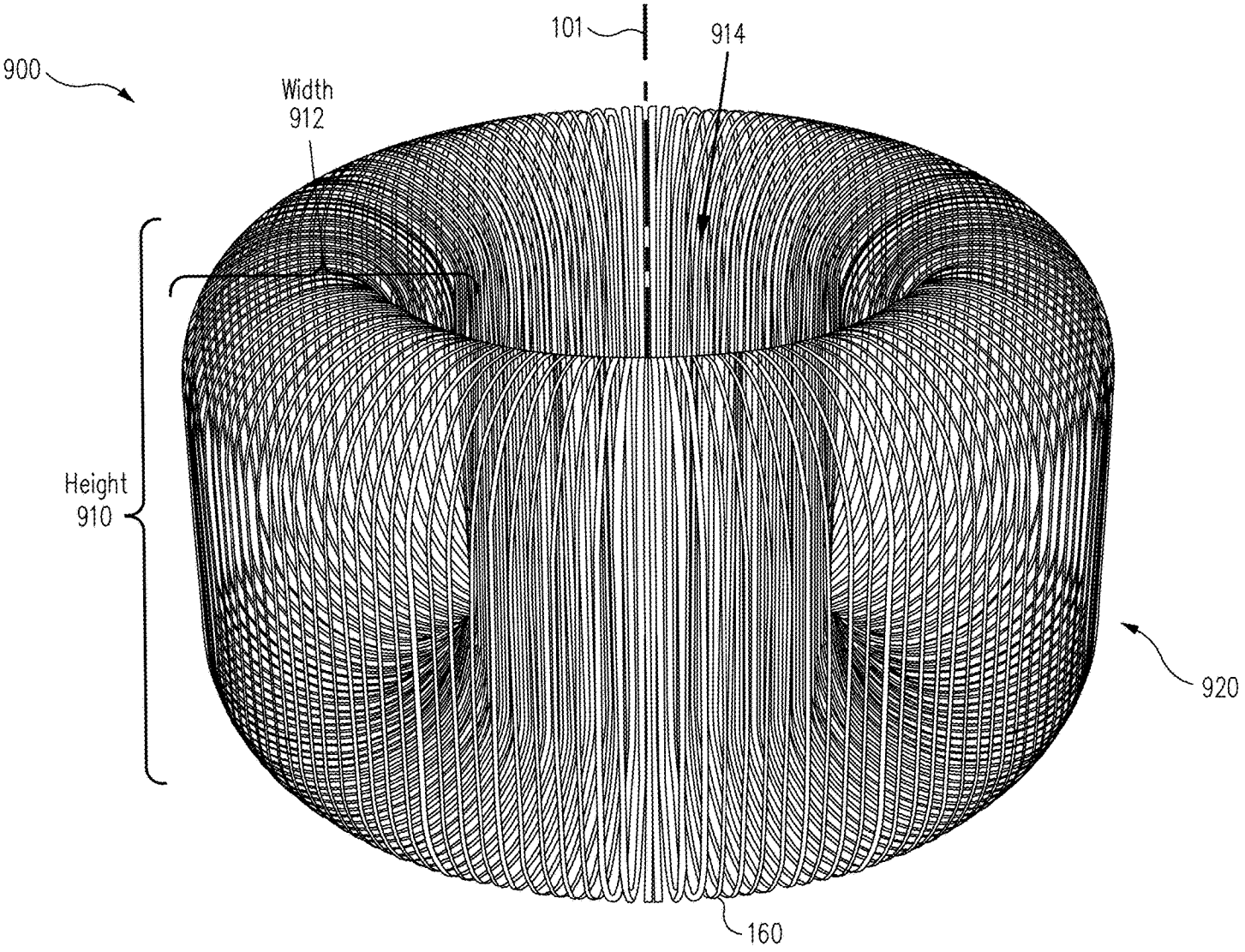
FIG. 9 illustrates a configuration of conductors for a toroidal power inductor in accordance with one or more embodiments of the disclosure.

Various configurations may be used to wind conductors 160 along exterior surface 112 of support structure 110 and within grooves 116. In one embodiment, illustrated by FIG. 9, a first configuration 900 of conductors for a toroidal power inductor may be a pancake configuration in which individual and separate grooves along a substantially poloidal direction are provided by support structure 110. In an embodiment, support structure 110 may have individual grooves that are separate and not interconnected (e.g., one groove does not connect to and one spacer does not connect to another spacer). Thus, conductors 160 received in each groove 116 are insulated from one another in exterior surface 112 to form multiple conductive loops about exterior surface 112 of support structure 110 (e.g., see FIG. 1). For example, each conductor 160 disposed in a groove 116 creates a singular ring about the exterior surface 112 of the inductor 100. In one or more embodiments, a plurality of conductors 160 may be layered within each isolated groove 116. Therefore, the rings may take form of a stack of one or more individual conductors (e.g., HTS tapes) with connections or conductive joints formed at the top or bottom of the torus (see FIGS. 1, 12B, and 13). In first configuration 900, portions of grooves 116 within inner portion 914 (e.g., along height 910 and arcuate widths 912 closer to centerline axis 101 of configuration 900) may be spaced closer together than portions of groves 116 along outer portion 920, such that spacers 114 may have different widths depending on their placement along inner portion 914, outer portion 910, and/or widths 912. In various embodiments, pancake configuration 900 may be advantageous due to ease of construction (e.g., simplicity of support structure construction and winding of conductors 160 about support structure 110) and due to each conductor loop being oriented substantially perpendicular to the local magnetic field generated in cavity 330, thus maximizing the inductance/volume efficiency of inductor 100.

Figure 10:
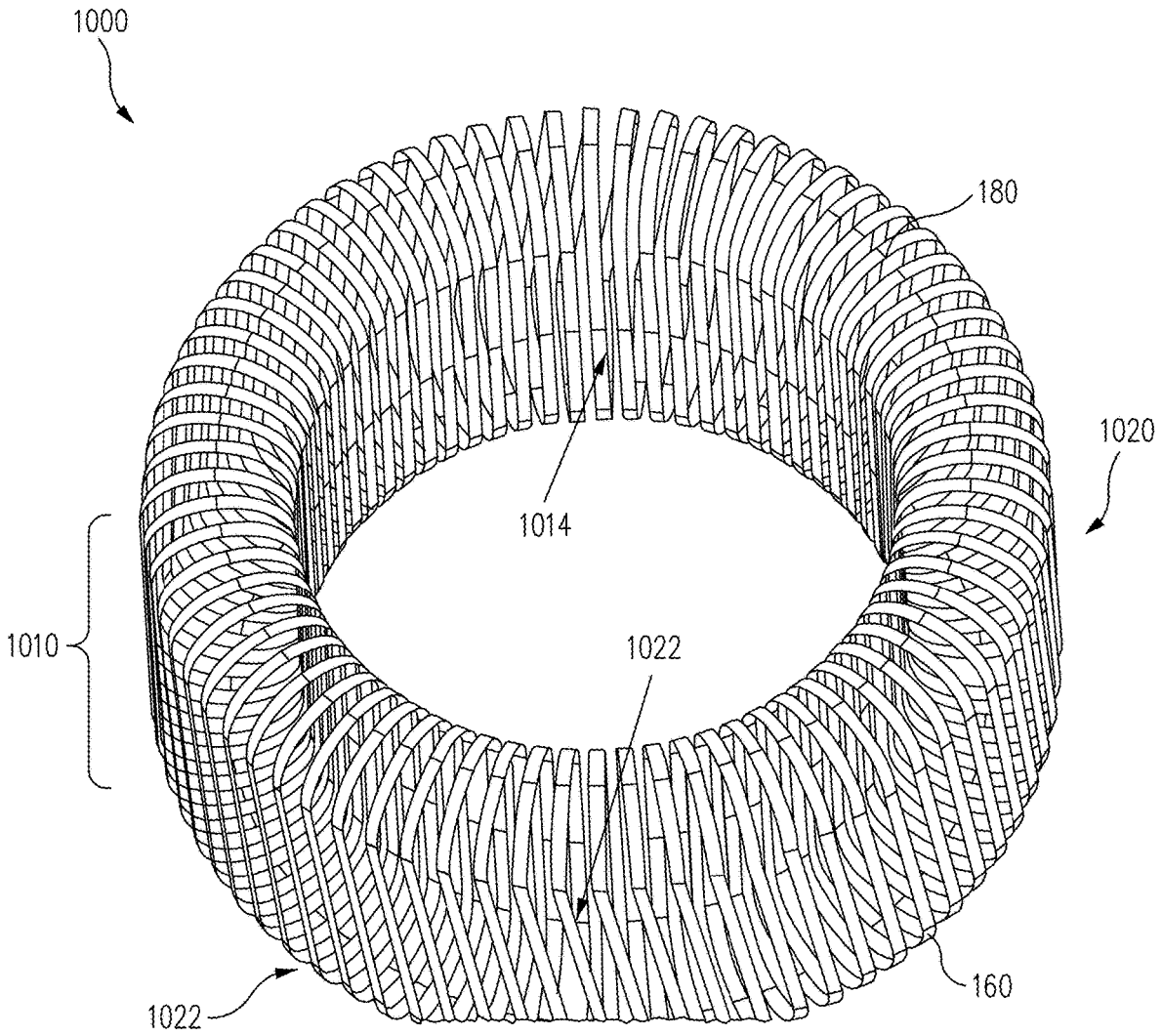
FIG. 10 illustrates a configuration of conductors for a toroidal power inductor in accordance with one or more embodiments of the disclosure.

FIG. 10 illustrates a second configuration 1000, i.e. a continuous configuration, of conductors for a toroidal power inductor. In various embodiments, grooves 116 of support structure 110 may form a single continuous exterior groove arranged in a substantially poloidal direction along exterior surface 112 and about support structure 110. For example, along an exterior portion 1020 of continuous configuration 1000, conductors 160 may be formed with two bends 1022 in order for the conductors 160 to join together into a single continuous winding about support structure 110, as shown. In such embodiments, grooves 116 and spacers 114 may be formed in exterior surface 112 to accommodate bends 1022 and the single continuous winding about support structure 110. In some embodiments, individual lengths of conductors 160 may be joined at one or more conductive joints 180 distributed substantially at the top or bottom of inductor 100, as shown in FIG. 10.

In some embodiments, conductors 160 may be formed from HTS tapes that may be relatively rigid and brittle, requiring grooves 116 to be shaped to accommodate a tilted face formed in conductors 160 to facilitate formation of bends 1022. Therefore, in continuous configuration 1000, a portion of conductors 160 disposed in the continuous groove 116 may form an angle relative to its width (e.g., azimuthally) and require support from exterior surface 112.

In related embodiments, a continuous winding of conductors 160 can be advantageous due to the winding not requiring conductive joints between rings of the conductors and thus not requiring a number of solder joints, often associated with resistive loss. A plurality of conductors 160 may be layered (e.g., stacked) in a continuous guide and wound in a toroidal shape along outer surface 112 of support structure 110. A possible disadvantage is that the corresponding support structure can be more complicated to manufacture than the support structure of, for example, pancake configuration 900, due to the angular deviation of the guides relative to the overall outer circumference of the torus, which can require precision in order to reduce risk of strain and damage to conductors 160. Moreover, the portions of conductors 160 proximate bends 1022 may also be non-perpendicular to the local magnetic field and thus not maximize the inductance/volume efficiency of an inductor implemented with such conductor configuration.

Figure 11:
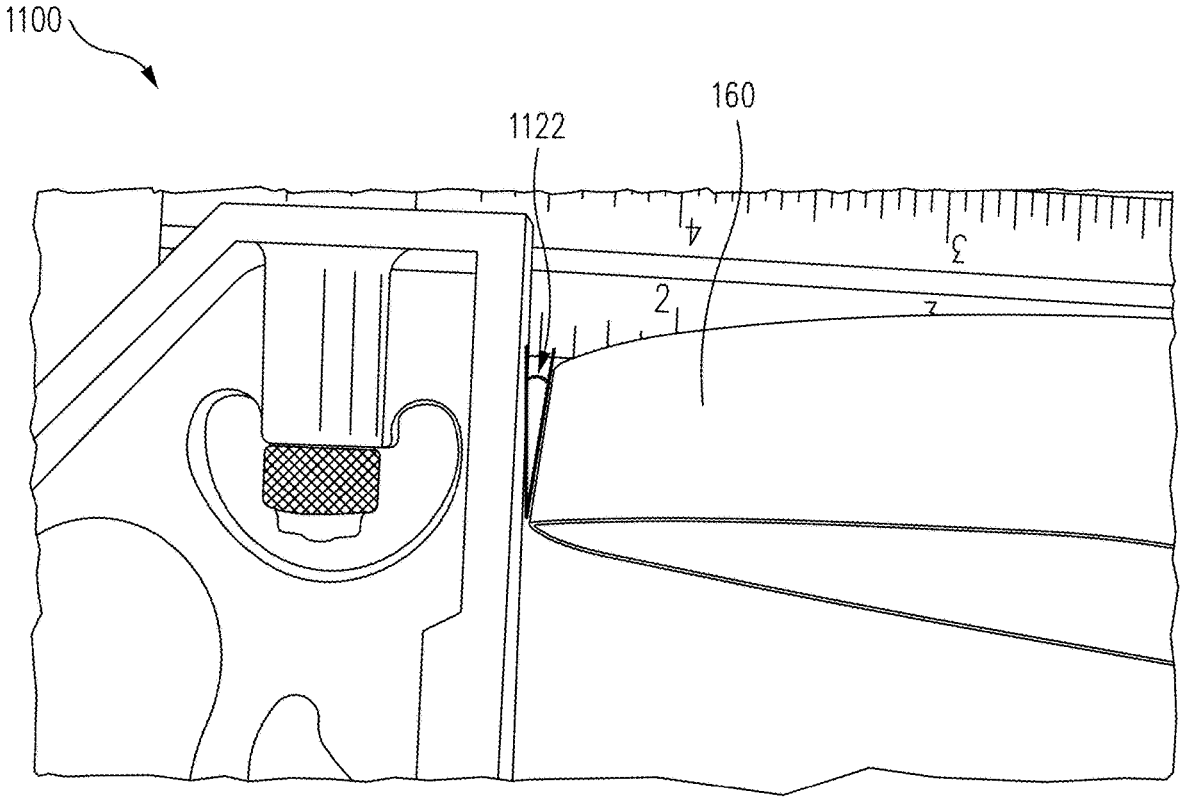
FIG. 11 illustrates a bend in a conductor to accommodate a configuration of conductors for a toroidal power inductor, in accordance with one or more embodiments of the disclosure.

In order to help counter such inefficiencies, conductors 160 may "cross over" and, in one or more embodiments, traverse at a diagonal along a height 1010 of outer portion 1020 and between bends 1022. For example, in one or more embodiments, conductors 160 may be angled and bent along outer portion 1020, near the volume where the magnetic field is lowest (e.g., see FIGS. 8A and 8B), and conductors 160 and their corresponding portion of grooves 116 proximate an inner portion 1014 of the exterior surface may be flat and perpendicular to the local magnetic field (similar to the pancake configuration 900 proximate inner portion 914). The grooves and spacers of the support structure for second configuration 1000 may be substantially parallel to each other in the poloidal direction with respect to the inner portion 1014 of configuration 1000. FIG. 11 shows an image 1100 of a conductor 160 as it would be arranged at bends 1022, illustrating that conductor 160 (and corresponding portions of the grooves) may form an angle 1122 relative to a surface of the toroidal support structure 110 in order to accommodate bends 1022 and continuous configuration 1000. In one or more embodiments, epoxy may be used to glue seams between conductors 160 if more than one conductor 160 is used for groove 116 of continuous configuration 1000.

In various embodiments, conductors 160 may be implemented by HTS tapes that can operate at temperatures above 20 K (e.g., at approximately 77 K or other cryogenic temperatures approaching the temperature of liquid nitrogen and/or vacuum pumped liquid nitrogen). For example, conductors 160 may include various 2G HTS materials (e.g., Superpower Inc.® 2G HTS wire), such as Y—Ba—Ca—O (YBCO), and other HTS materials that can be formed into commercially available HTS tapes. Furthermore, the HTS tapes may include silver disposed between layers of an HTS tape and also may have an outer coat of stabilizing copper, which may be easily soldered and be configured to provide rounded edges to minimize risk of damage during assembly. The HTS tapes may be, for example, approximately 1 cm in width, approximately between 0.1 and 1 mm or less in thickness, and be provided in various lengths (e.g., in spools up to 1 km in length). Multiple tapes may be stacked or layered to form a single conductor 160 or multiple conductors within a single groove; for example, 3 to 5 layers of HTS tapes may be disposed in a single groove 116 in order to provide thermal robustness or multiple separate co-located windings. For example, if a layer of a conductor 160 on inductor 100 goes normal, remaining superconducting layers may carry the current until the thermal excursion is remedied. In an embodiment, approximately 1000 A of current may be provided to conductors 160 (e.g., approximately 200 A/tape in a 5 layer conductor). Each tape may by itself have a critical current of approximately 300 amperes; however, if a section of the tape is damaged or heated and becomes resistive, the remaining layers may redistribute the current among the undamaged portions of the conductor 160 and inductor 100 can continue to be fully functional. Such a situation may result in an increase in temperatures of the tapes, however, the inductor will not quench as a result.

Figure 12A:
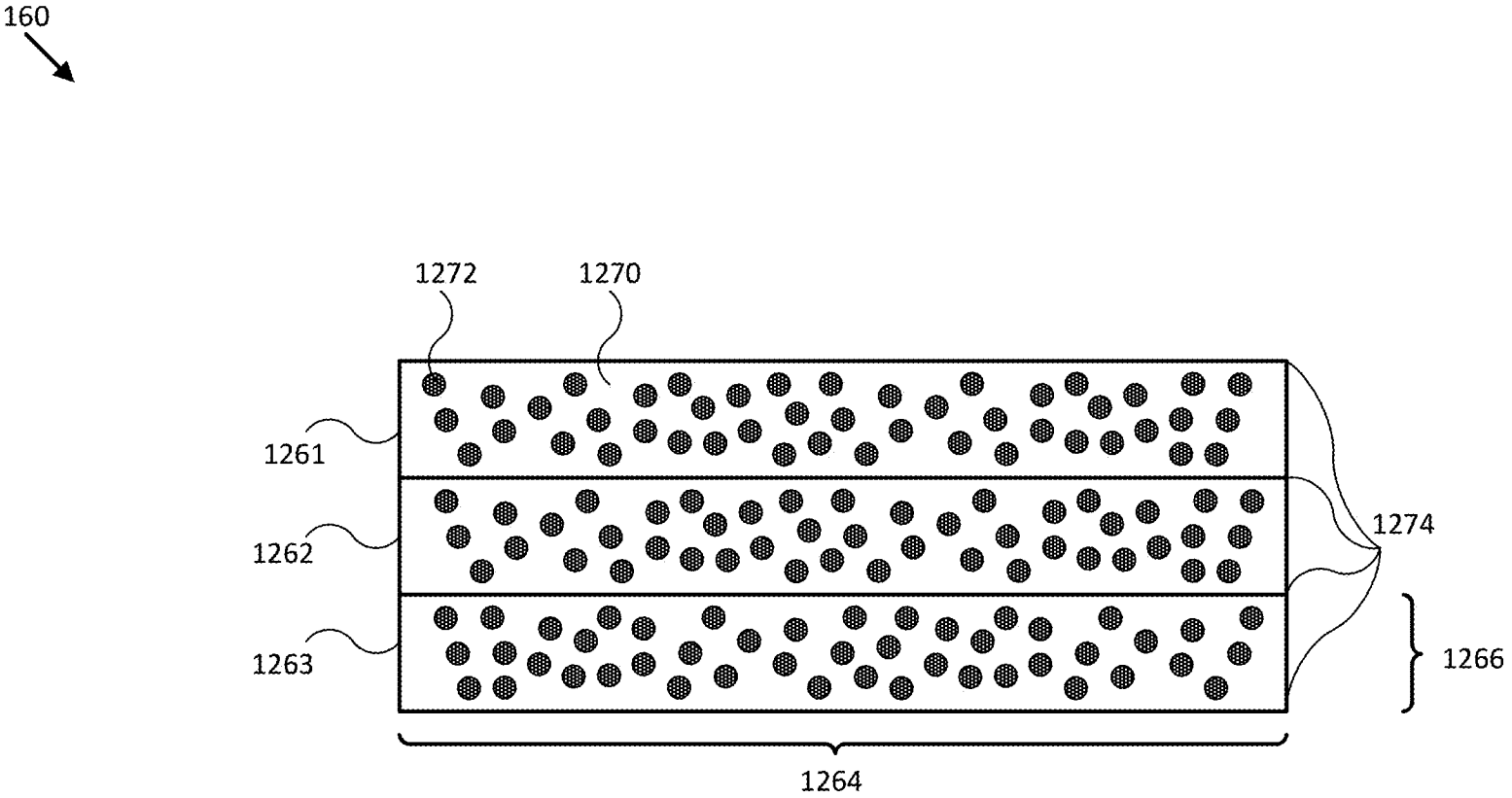
FIG. 12A illustrates a cross section view of a conductor in accordance with one or more embodiments of the disclosure.

FIG. 12A illustrates a cross section view of conductor 160 in accordance with one or more embodiments of the disclosure. As shown in FIG. 12A, conductor 160 includes three HTS tape layers 1261, 1262, and 1263, each approximately 1 cm in width 1264 and approximately 0.1 mm in thickness 1266, to form conductor 160 approximately 1 cm wide and 0.3 mm thick. Each HTS tape may include a film or layer of HTS material 1272 (e.g., extending along the length of the tape layer, or in to/out of the page depicting FIG. 12A) within a normal metal stabilizer layer or layers 1270. Each layer may be conductively coupled to another layer at joints 1274, e.g., using a conductive adhesive, solder paste, or solder, for example, to form a single monolithic conductor 160. In alternative embodiments, one or more of joints 1274 may be insulating joints so as to form multiple different conductors 160 configured to occupy the same groove 116.

Figure 12B:
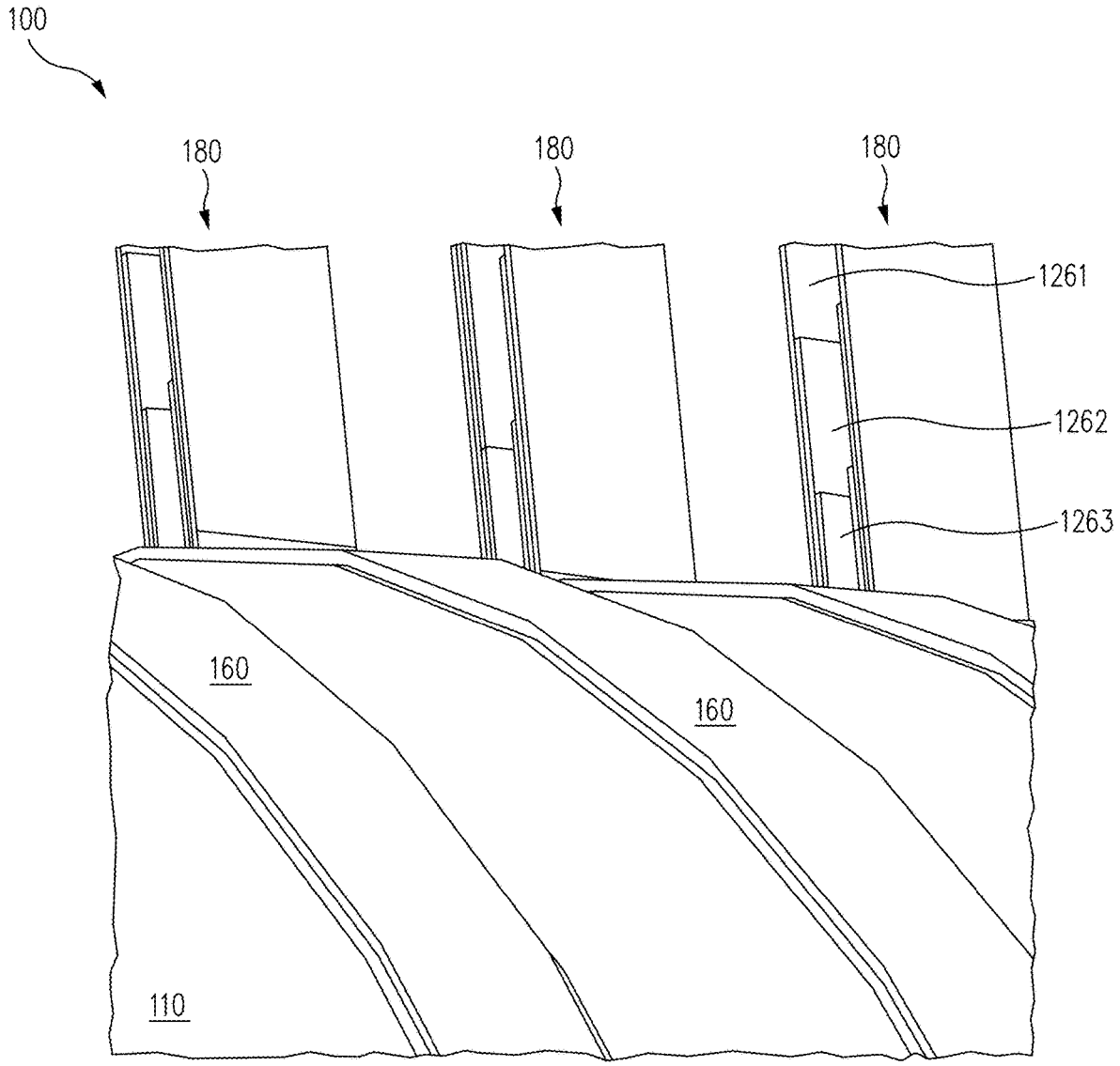
FIG. 12B illustrates conductors wound around a support structure for a toroidal power inductor in accordance with one or more embodiments of the disclosure.

In various embodiments, configurations 900 and 100 may include one or more conductive joints. For example, FIG. 12B illustrates conductive joints 180 of pancake configuration 900. Conductors 160 may be layered in each of single grooves 116 of support structure 110 (e.g., 15 tapes/turn). In order to electrically couple the isolated conductors 160 disposed in each groove 116, the ends of each layer of conductors 160 may be staggered and joined at conductive joints 180. Therefore, both ends of each layers of a conductor 160 in each groove 116 may be included in conductive joints 180. For example, conductive joints 180 may include both ends of inner conductor 1261, middle conductor 1262, and outer conductor 1263, wither the ends are insulated from each other but conductively coupled to other conductors.

Figure 13:
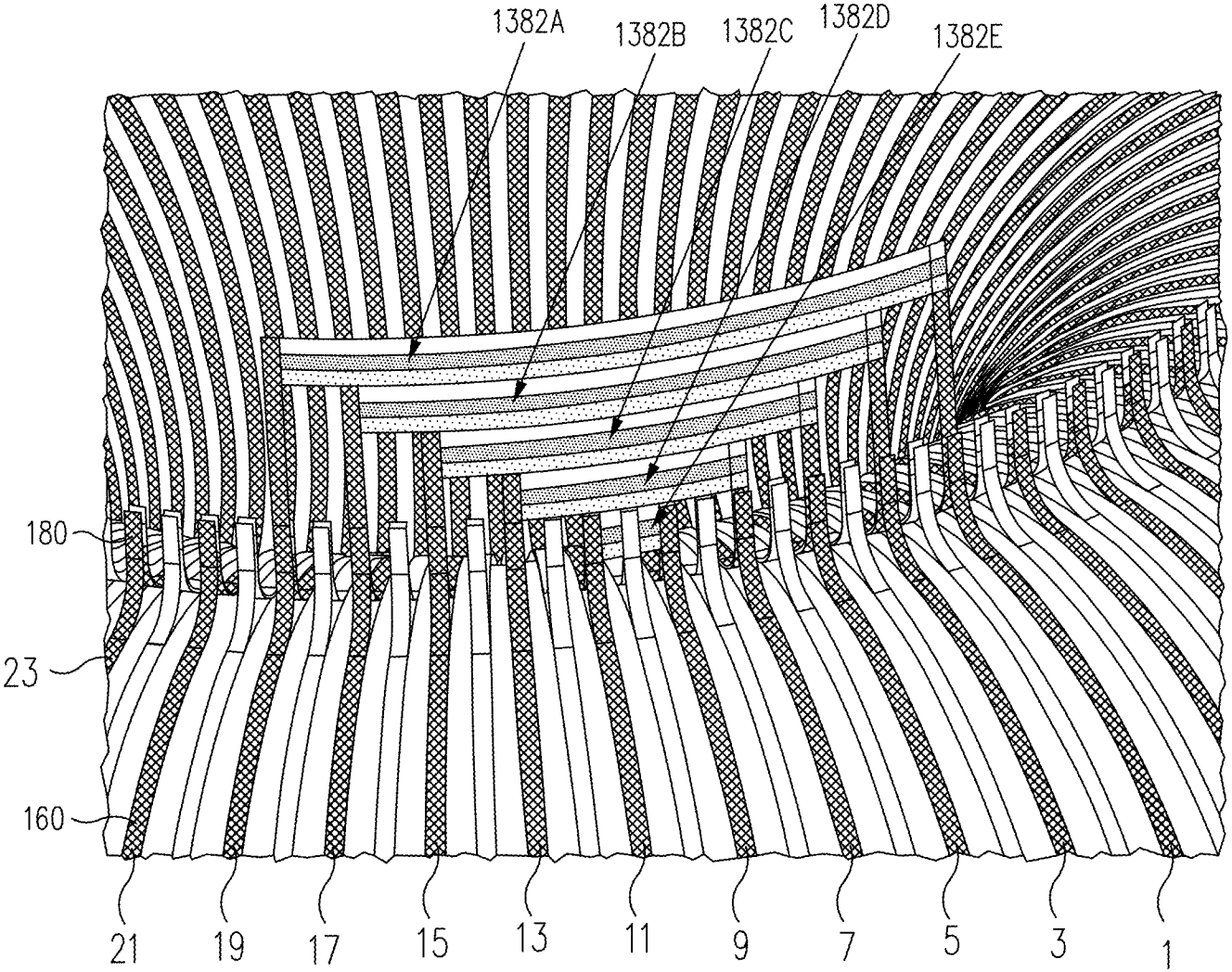
FIG. 13 illustrates conductive joints for a toroidal power inductor in accordance with one or more embodiments of the disclosure.

The HTS tapes of a conductor 160 in a given ring or winding must be connected to other HTS tapes of other conductors 160 in inductor 100 to have connected turns and a complete electrical circuit. In various embodiments, HTS tapes similar to those used to form conductors 160 may be used to make these inter-conductor connections. For example, such connecting HTS tapes may be soldered to the ends of the HTS tapes of the conductors 160 in order to make the connections. FIG. 13 shows an example of such connections for the case where the inductor includes two interleaved phases and a turn of each phase includes 15 HTS tapes in parallel, arranged as 5 parallel rings, with 3 HTS tapes per ring/conductor 160. In FIG. 13, the connecting HTS tapes are visibly differentiated for easy identification of which HTS tape in a conductor 160 the connection is to. An HTS tape from the inside ring end is connected to the outside ring of its connecting ring to keep the current flowing in the same direction around the toroidal inductor. The connections repeat in the same pattern around the toroidal inductor. The rings for the first phase are numbered odd (1, 3, 5, 7, 9, 11, 13, 15, 17, 19, 21, 23) circumferentially around the torus, and the rings for the second phase would be numbered even.

In particular, FIG. 13 illustrates 5 connections 1382A-E (e.g., each implemented by at least three parallel HTS tapes) between conductive joints 180 that are configured to carry a single current distributed across all 15 HTS tapes. The 3 HTS tapes of each connection may be soldered together to form conductive joints 180, as shown. For example, as shown in FIG. 13, ring 1 connects to ring 19; ring 3 connects to ring 17; ring 5 connects to ring 15; ring 7 connects to ring 13; and ring 9 connects to ring 11. For the next set of connections (not shown): ring 11 would connect to ring 39; ring 13 would connect to ring 37; etc., with the same geometry of connections. As understood by one skilled in the art other connections schemes are possible. In one or more embodiments, 5 grooves (e.g., pancakes of pancake configuration 900) may be used per turn (for one phase of inductor 100). Furthermore, each connection 1382A-E of coupled conductive joints 180 may be interleaved or woven together.

Figure 14A:
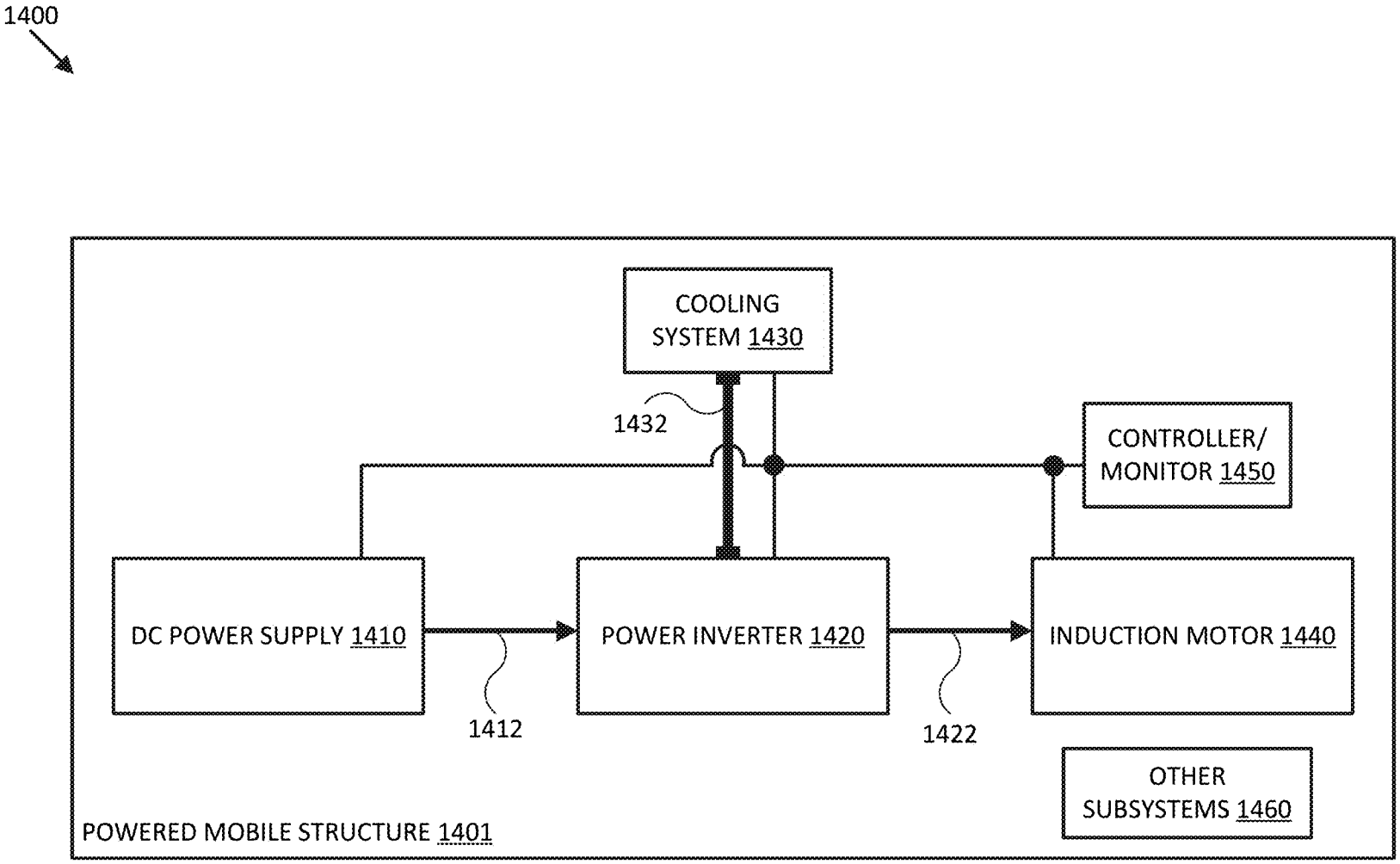
FIG. 14A illustrates block diagram of an electrical power system including a mobile structure and a power inverter in accordance with one or more embodiments of the disclosure.

FIG. 14A illustrates a block diagram of an electrical power system 1400 including a mobile structure and a power inverter in accordance with one or more embodiments of the disclosure. For example, a powered mobile structure 1401 (an aircraft, aerospace vehicle, terrestrial vehicle, maritime vessel, or any combination thereof, such as hybrid or amphibious vehicle) may include a DC power supply 1410, a cooling system 1430, a power inverter 1420, a controller/monitor 1450, an induction motor 1440, and/or other subsystems 1460. DC power supply 1410 may be implemented by a battery and/or generator or generating system, for example, and be configured to deliver DC power to power inverter 1420 over DC power line 1412. Power inverter 1420, which may include embodiments of power inductor 100 of FIG. 1, may include various electrical components and be configured to receive DC power from DC power supply 1410 and provide AC power to, for example, induction motor 1440 over AC power line 1422. In various embodiments, cooling system 1430 may be configured to provide fluid or gaseous coolant to power inverter 1420 over coolant line 1432 in order to facilitate cooling of various components of power inverter 1420, including embodiments of power inductor 100.

Cooling system 1430 may in some embodiments be a standalone and/or recirculating refrigeration system configured primarily to provide cryogenic coolant to power inverter 1420 and/or other systems of powered mobile structure 1401. In other embodiments, cooling system 1430 may be part of a propulsion system configured to use cryogenic fuel, for example, and be configured to divert some of the cryogenic fuel to power inverter 1420 for cooling components of power inverter 1420 prior to combustion of the cryogenic fuel (e.g., after the fuel flows to a combustion chamber over a coolant line similar to coolant line 1432, both possible components of other subsystems 1460). Operation of DC power supply 1410, power inverter 1420, cooling system 1430, induction motor 1440, and/or other subsystems 1460 may be controlled and/or monitored by controller/monitor 1450, which may be implemented as one or more digital and/or analog devices configured to interface with the various components of system 1400 and execute software, such as a control loop, configured to facilitate operation of system 1400. In various embodiments, controller/monitor 1450 may also include a display or touch screen and a user interface configured to receive user input and provide feedback to a user corresponding to operation of system 1400.

In some embodiments, induction motor 1440 may form part of an aircraft electric propulsion drive that may affect, for example, the motor speed control of the aircraft. For example, in one embodiment, power inverter 1420 may be implemented as a 1-MW inverter that converts DC to AC at frequencies as high as 3 kHz to meet anticipated needs of an aircraft electric propulsion system. Power inverter 1420 may be implemented with a power to weight ratio of approximately 26 kW/kg or higher and with an efficiency of approximately 99.3% or higher.

Figure 14B:
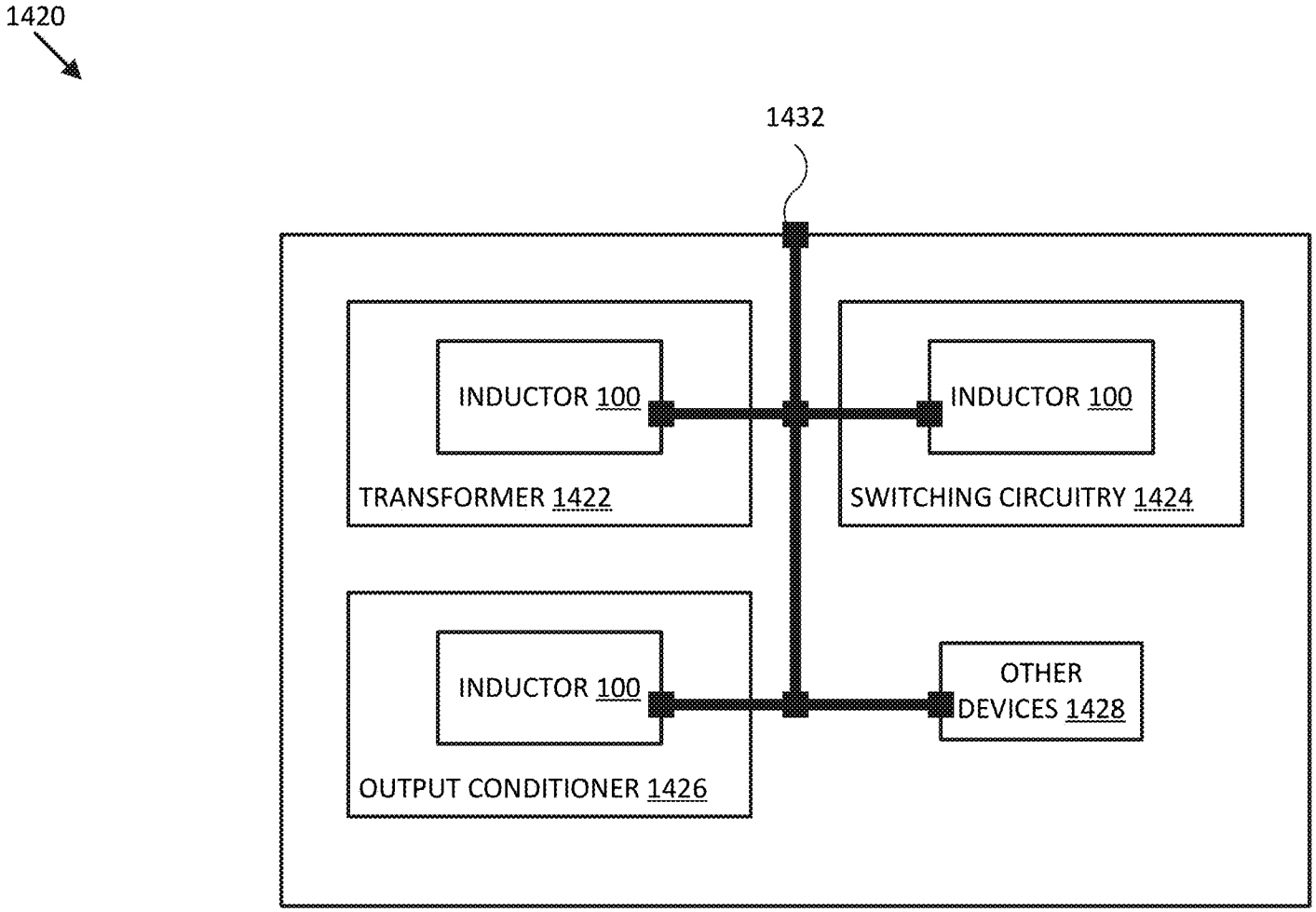
FIG. 14B illustrates a block diagram of a power inverter including one or more toroidal power inductors and/or similar components in accordance with one or more embodiments of the disclosure.

FIG. 14B illustrates a block diagram of power inverter 1420 including one or more power inductors 100 and/or similar components in accordance with one or more embodiments of the disclosure. As shown in FIG. 14B, power inverter 1420 may include one or more inductors 100 cooled via coolant line 1432, which may be configured to provide coolant to all power inductors 100 and/or to return coolant to cooling system 1430 or other subsystems 1460. For example, power inductor 1420 may include transformer 1422 (e.g., which may be implemented by an embodiment of power inductor 100 comprising multiple and mutually inductive windings), switching circuitry 1424 (e.g., which may be implemented with an embodiment of power inductor 100 configured to operate at relatively high switching frequencies, such as at or above 3 kHz), output conditioner 1426 (e.g., which may be implemented with an embodiment of power inductor 100 configured to provide output filtering for power inverter 1426), and/or one or more other devices 1428 (e.g., other electrical power devices configured to use power inductors).

Figure 15:
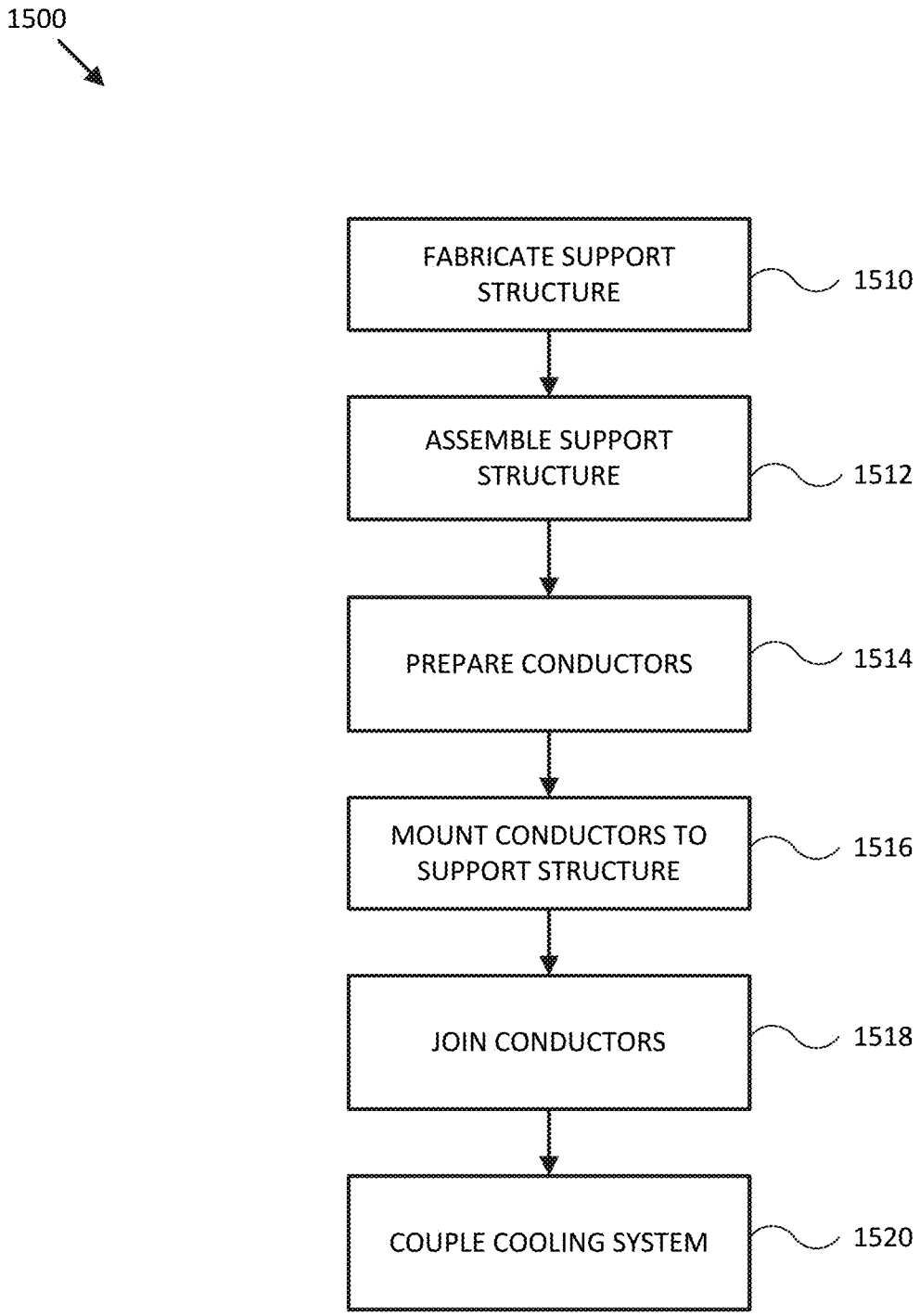
FIG. 15 illustrates a flow diagram of various operations to provide a toroidal power inductor in accordance with one or more embodiments of the disclosure.

FIG. 15 illustrates a flow diagram of various operations to provide a toroidal power inductor in accordance with one or more embodiments of the disclosure. In some embodiments, the operations of FIG. 15 may be implemented as software instructions executed by one or more logic devices used to implement a toroidal power inductor. More generally, the operations of FIG. 15 may be implemented with any combination of software instructions, electronic hardware (e.g., inductors, capacitors, amplifiers, or other analog and/or digital components), and/or mechanical hardware used to assemble a toroidal power inductor. It should be appreciated that any step, sub-step, sub-process, or block of process 1500 may be performed in an order or arrangement different from the embodiment illustrated by FIG. 15.

In block 1510 a support structure is fabricated. For example, support structure 110 may be fabricated in one or more sub-portions using a variety of techniques or combinations of techniques described herein, such as molding, carving, machining, casting, and/or 3D printing. In some embodiments, multiple portions, pieces, of halves of support structure 110 may be fabricated so as to require further assembly, as described herein, and in other embodiments, support structure 110 may be fabricated as a single monolithic structure, such as through various types of additive manufacturing (e.g., 3D printing techniques).

For example, a 3D printer may be used to fabricate a precise and light-weight support structure as one integrated structure (e.g., outer shell 310 with associated surface structures, inner shell 320 with associated surface structures, and channel dividers 322). Thus, the entire support structure may be printed without any sealed joints. Support structure 110 may also be fabricated using molding fabrication. For example, overlapping layers may be patterned, overlapped, and draped over a mold. A mold may be provided for various sections of support structure 110: a bottom and an upper half of outer shell 310 and a bottom and an upper half of inner shell 320. The layered material for the support structure may be placed in a vacuum bag and compressed while remaining on the molds for proper curing, using various known curing techniques. The constructed shells may then be removed from the vacuum bag and be ready for assembly. If grooves 116/316 are not created during the molding process, an additional step prior to assembly may require grooves 116/316 to be etched, machined, or otherwise formed out of their corresponding surfaces.

In another embodiment, castable molding may be used to provide support structure 110. A mold press may be used to produce portions of the support structure of the inductor. For example, castable ceramics with silica carbide may be pressed into a mold to form a portion of support structure 110 (e.g., bottom and upper halves of inner and outer shells, or subsections of such structures). In some embodiments of the mold and press method, at least one side would be required to be solid, and portions of the support structure would require machining to remove excess material prior to assembly. In general, support structure 110 may be made with any material that withstands cryogenic temperatures. Such materials may include but are not limited to G-10 fiberglass composite, PEKK, silica carbide fibers, alumina, and alumina nitrate.

In a further embodiment, a secondary outer shell (e.g., similar to outer shell 310 but configured to encompass power inductor 100, conductor joints 180, and/or connections similar to connections 1382A-E, for example) may be provided to at least partially enclose inductor 100 and further provide protection of conductors 160, aiding in prevention of displacement of conductors 160, preventing arcing between conductors 160, and/or protecting conductors 160 foreign substances and possible physical damage. Furthermore, the secondary outer shell may comprise a secondary coolant flow to further cool conductors 160 while keeping conductors 160 physically isolated from the cryogenic fluid.

In block 1512 the support structure fabricated in block 1510 is assembled. For example, if fabricated in multiple pieces, the separate pieces of support structure 110 may be assembled to form support structure 110. Separate pieces of the support structure may be assembled using, for example, adhesives and any other known methods that may secure the separate pieces together. In addition to support structure 110 itself, thermal insulation layers may be added to the interior or exterior of support structure 110 to prevent condensation. In further embodiments, vents that to the surrounding atmosphere may be provided in the shells in order to prevent stress on the support structure and allow for pressure equalization to cavity 330.

In block 1514, conductors are prepared. For example, conductors 160 may be wrapped in a protective film (e.g., Kapton® polyimide film) prior to being wound around support structure 110. In some embodiments, a film may be provided with adhesive and thus be applied to conductors 160 in preparation of being seated within grooves 116. In another embodiment, the film may applied to conductors 160 and then heated to high temperatures (e.g., approximately 400 K) such that the applied heat results in the film shrinking and completely sealing and insulating the conductors and helping to prevent the conductors from arcing between each other. In block 1516, the conductors prepared in block 1514 are mounted to the support structure fabricated in block 1510 and/or assembled in block 1512. For example, conductors 160 may be wound in a substantially poloidal directional along exterior surface 112 of support structure 110. Depending on whether support structure grooves are, for example, a pancake or continuous configuration, conductors 160 may be disposed in a single continuous groove or discrete, separate grooves.

In block 1518 the conductors are joined. For example, after being mounted to support structure 110, conductors 160 may be joined to form multiple windings or turns, and/or multiple phases or mutually inductive windings. In some embodiments of a continuous configuration, separate conductors 160 in the continuous groove may be joined together to form a single continuous winding. In some embodiments of the pancake configuration, one or more layers of conductors 160 in each isolated groove 116 may be soldered together to provide a conductive joint 180. The conductive joints 180 may then be coupled to various other conductive joints 180 using connections 1382, for example, according to a particular pattern, which may be dictated by current carrying requirements for the power inductor and current carrying limits of the individual conductors 160 and/or their constituent superconducting tapes. In various embodiments, connections 1382 may include tape layers soldered parallel to each other or interleaved with respect to each other.

In block 1520, a cooling system is coupled to a toroidal power inductor including the conductors joined in block 1518. For example, a cooling system, which may be a component of a powered mobile structure, may be configured to couple to power inductor 100 using one or more coolant lines 1432 and provide coolant (e.g., cryogenic fluid or gas, or cryogenic fuel) to inductor 100 in order to extract heat from power inductor 100 and cool conductors 160 sufficiently to allow them to superconduct power-level currents (e.g., approximately 1000 A or greater per phase of power inductor 100). Support structure 110 may be configured to conduct coolant may through coolant channels 324 circumferentially or in a substantially poloidal direction along interior grooves 316 provided by interior surface 318 of outer shell 310 and sealed by spacers/ribs 314 against outer surface 312 of inner shell 320. Grooves 316 and spacers 314 of interior surface 318 may be in a pancake or continuous configuration to complement the groove configuration on exterior surface 112 so that the coolant remains adjacent to conductors 160 on exterior surface 112.

Accordingly, embodiments of the present disclosure provide a high efficiency, high power to weight ratio, and compact power inductor for use in a variety of power applications, particularly with respect to output filters for power inverters used by electrically powered propulsion systems where component weight and volume are often inversely proportional to the overall efficiency and range of the propulsion system and/or the mobile structure powered by the propulsion system. In addition, embodiments of the present disclosure may be used to implement a variety of different types of power components related to inductor-type structures, such as power transformers, that can be operated with extremely high efficiencies at relatively high frequencies, as compared to conventional metal-core inductive power components.

Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice-versa.

Software in accordance with the present disclosure, such as non-transitory instructions, program code, and/or data, can be stored on one or more non-transitory machine readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

Embodiments described above illustrate but do not limit the invention. It should also be understood that numerous modifications and variations are possible in accordance with the principles of the invention. Accordingly, the scope of the invention is defined only by the following claims.

What is claimed is:

1. A toroidal power inductor comprising:

a toroidal support structure comprising a toroidal outer shell, a toroidal inner shell inside a toroidal volume inside the outer shell, and one or more coolant channels formed between the inner and outer shells;

a plurality of conductors wrapped around and supported by an exterior surface of the outer shell, wherein the plurality of conductors are configured to provide an inductance for the toroidal power inductor, and wherein the one or more coolant channels are distributed beneath the exterior surface of the outer shell to cool the plurality of conductors; and an interior cavity enclosed by the inner shell of the toroidal support structure;

wherein the power inductor is an air-core inductor.

2. The toroidal power inductor of claim 1, wherein the outer shell comprises one or more exterior grooves configured to receive the plurality of conductors and a corresponding one or more raised spacers disposed between the one or more exterior grooves and configured to prevent the plurality of conductors from being displaced along the exterior surface of the support structure.

3. The toroidal power inductor of claim 2, wherein the one or more exterior grooves comprise a plurality of separate exterior grooves corresponding to the plurality of conductors and arranged substantially in a poloidal direction about the support structure.

4. The toroidal power inductor of claim 2, wherein the one or more exterior grooves comprise a single continuous exterior groove arranged substantially in a poloidal direction about the support structure.

5. The toroidal power inductor of claim 1, wherein each one of the plurality of conductors comprises two or more superconductor tapes, and wherein the two or more superconductor tapes are insulated from one another to form multiple conductive loops about the exterior surface of the support structure.

6. The toroidal power inductor of claim 5, wherein the two or more superconductor tapes comprise high-temperature superconductor tapes.

7. The toroidal power inductor of claim 1, further comprising:

a plurality of conductive joints configured to couple at least portions of the plurality of conductors and form multiple separate windings about the toroidal support structure.

8. The toroidal power inductor of claim 1, wherein at least one of the one or more coolant channels reaches the outer shell to allow physical contact between the coolant and an interior surface of the outer shell.

9. A power inverter comprising the toroidal power inductor of claim 1.

10. A toroidal power inductor comprising:

a toroidal support structure comprising an outer shell, an inner shell, and one or more coolant channels formed therebetween;

a plurality of conductors wrapped around and supported by an exterior surface of the outer shell, wherein the plurality of conductors are configured to provide an inductance for the toroidal power inductor, and wherein the one or more coolant channels are distributed beneath the exterior surface of the outer shell to cool the plurality of conductors; and an interior cavity enclosed by the inner shell of the toroidal support structure;

wherein the support structure further comprises:

one or more interior grooves formed on an interior surface of the outer shell and adjacent the plurality of conductors, wherein the one or more interior grooves are configured to form at least a portion of the one or more coolant channels; and one or more inlets and outlets formed in the outer shell and configured to transfer cryogenic fluid to or from the one or more interior grooves.

11. The toroidal power inductor of claim 10, wherein the toroidal power inductor is mounted within a mobile structure, and wherein the cryogenic fluid comprises a cryogenic fuel for the mobile structure.

12. A mobile structure comprising:

a direct current "DC" power supply;

an induction motor; and a power inverter comprising the toroidal power inductor of claim 1 and configured to power the induction motor using power provided by the DC power supply.

13. A method of assembling a toroidal power inductor, comprising:

fabricating a toroidal support structure for the toroidal power inductor, wherein the toroidal support structure comprises a toroidal outer shell, a toroidal inner shell inside a toroidal volume inside the outer shell, and one or more coolant channels formed between the inner and outer shells, and wherein the inner shell is configured to form an interior cavity enclosed by the inner shell of the toroidal support structure;

assembling the support structure;

preparing a plurality of conductors configured to provide an inductance for the toroidal power inductor; and mounting the plurality of conductors to the support structure to obtain the toroidal power inductor which is an air-core inductor, wherein the plurality of conductors are wrapped around and supported by an exterior surface of the outer shell, and wherein the one or more coolant channels are distributed beneath the exterior surface of the outer shell to cool the plurality of conductors.

14. The method of claim 13, wherein the fabricating the support structure comprises forming, in the outer shell, one or more exterior grooves configured to receive the plurality of conductors and a corresponding one or more raised spacers disposed between the one or more exterior grooves and configured to prevent the plurality of conductors from being displaced along the exterior surface of the support structure.

15. The method of claim 14, wherein the one or more exterior grooves comprise a plurality of separate exterior grooves corresponding to the plurality of conductors and arranged substantially in a poloidal direction about the support structure.

16. The method of claim 14, wherein the one or more exterior grooves comprise a single continuous exterior groove arranged substantially in a poloidal direction about the support structure.

17. The method of claim 13, wherein:

each one of the plurality of conductors comprises two or more superconductor tapes;

the two or more superconductor tapes are insulated from one another to form multiple conductive loops about the exterior surface of the support structure; and the support structure comprises a substantially circular, ellipsoid, or rectangular cross section.

18. The method of claim 13, further comprising:

forming a plurality of conductive joints configured to couple at least portions of the plurality of conductors and form multiple separate windings about the toroidal support structure.

19. The method of claim 13, wherein the one or more coolant channels are a plurality of the coolant channels, and the fabricating the support structure comprises forming one or more channel dividers coupled between the outer shell and the inner shell and configured to define the coolant channels, wherein the coolant channels are configured to allow cryogenic fluid provided by a coolant system to flow adjacent to the plurality of conductors and transfer heat away from the plurality of conductors.

20. The method of claim 13, wherein the fabricating the support structure comprises:

forming one or more interior grooves on an interior surface of the outer shell and adjacent the plurality of conductors, wherein the one or more interior grooves are configured to form at least a portion of the one or more coolant channels; and forming one or more inlets and outlets in the outer shell and configured to transfer cryogenic fluid to or from the one or more interior grooves.

* * * * *